US010320119B2

(12) United States Patent
Shimeno et al.

(10) Patent No.: US 10,320,119 B2
(45) Date of Patent: Jun. 11, 2019

(54) CONNECTOR DEVICE

(71) Applicant: Japan Aviation Electronics Industry, Limited, Tokyo (JP)

(72) Inventors: Ryuzo Shimeno, Tokyo (JP); Yuya Tabata, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/021,252

(22) Filed: Jun. 28, 2018

(65) Prior Publication Data

US 2019/0058286 A1 Feb. 21, 2019

(30) Foreign Application Priority Data

Aug. 18, 2017 (JP) ..... 2017-157997

(51) Int. Cl.
*H01R 13/04* (2006.01)
*H01R 13/10* (2006.01)
(Continued)

(52) U.S. Cl.
CPC ..... *H01R 13/62938* (2013.01); *H01R 13/04* (2013.01); *H01R 13/10* (2013.01);
(Continued)

(58) Field of Classification Search
CPC ..... H01R 13/62938; H01R 13/641; H01R 13/6272; H01R 13/62933; H01R 13/639;
(Continued)

(56) References Cited

U.S. PATENT DOCUMENTS 5,417,586 A * 5/1995 Endo ..... H01R 13/641 439/353
6,213,791 B1 * 4/2001 Kodama ..... H01R 13/62905 439/157
(Continued)

FOREIGN PATENT DOCUMENTS

EP 2 325 953 A1 5/2011
EP 2 811 586 A1 12/2014
(Continued)

OTHER PUBLICATIONS

Extended European Search Report dated Dec. 10, 2018 in European Application No. 18 182 557.1.

*Primary Examiner* — Gary F Paumen
(74) *Attorney, Agent, or Firm* — Collard & Roe, P.C.

(57) ABSTRACT

A connector device comprises a connector and a mating connector mateable with each other. The connector comprises a housing, a sub-housing movable relative to the housing and a detection terminal held by the sub-housing. The mating connector comprises a mating housing and a mating detection terminal held by the mating housing. The housing is turnable about a shaft thereof relative to the mating housing. The sub-housing has a guided portion. The mating housing has a guide portion. While the housing is turned relative to the mating housing, the guide portion guides the guided portion to move the sub-housing relative to the housing. As a result, the detection terminal is moved downward along an upper-lower direction perpendicular to an axial direction of the shaft to be connected to the mating detection terminal.

14 Claims, 13 Drawing Sheets

(51) Int. Cl.
*H01R 13/502* (2006.01)
*H01R 13/629* (2006.01)
*H01R 13/703* (2006.01)

(52) U.S. Cl.
CPC ..... *H01R 13/502* (2013.01); *H01R 13/703* (2013.01); *H01R 13/6295* (2013.01); *H01R 2201/26* (2013.01)

(58) Field of Classification Search
CPC .. H01R 13/62955; H01R 13/10; H01R 13/04; H01R 13/502
USPC ..... 439/489, 372, 157, 374
See application file for complete search history.

(56) References Cited

U.S. PATENT DOCUMENTS 7,287,993 B2 * 10/2007 Fujii ..... H01R 13/62938 439/157
7,445,491 B2 * 11/2008 Fujii ..... H01R 13/62938 439/157
7,918,676 B2 * 4/2011 Tonosaki ..... H01R 13/7031 439/157
8,303,320 B2 11/2012 Loncar et al.
9,018,550 B2 * 4/2015 Kobayashi ..... H01H 9/0066 200/50.01
9,893,469 B2 2/2018 Tabata et al.
9,966,701 B2 5/2018 Tabata et al.
10,008,805 B2 * 6/2018 Tabata ..... H01R 13/7036
2002/0173185 A1 * 11/2002 Fukushima ..... H01R 13/62938 439/157
2007/0072482 A1 * 3/2007 Fujii ..... H01R 13/62938 439/489
2007/0149041 A1 * 6/2007 Fujii ..... H01R 13/641 439/489
2009/0325411 A1 * 12/2009 Matsumura ..... H01R 13/6295 439/157
2013/0017697 A1 * 1/2013 Furuya ..... H01R 13/62905 439/157
2014/0364010 A1 * 12/2014 Kuwahara ..... B60L 3/00 439/626
2015/0004829 A1 * 1/2015 Aoki ..... H01R 13/629 439/372
2015/0064953 A1 * 3/2015 Iwatani ..... H01R 13/62933 439/341
2015/0064954 A1 * 3/2015 Tabata ..... H01R 13/62905 439/342
2015/0079830 A1 * 3/2015 Iwatani ..... H01R 13/6295 439/310
2016/0056573 A1 2/2016 Kamei et al.
2017/0331226 A1 * 11/2017 Tabata ..... H01R 13/62938
2018/0054025 A1 * 2/2018 Tabata ..... H01R 13/62933
2018/0145453 A1 * 5/2018 Tabata ..... H01R 13/11
2018/0145454 A1 * 5/2018 Tabata ..... H01R 13/7036

FOREIGN PATENT DOCUMENTS

EP 2 843 773 A1 3/2015
JP 2014-238929 A 12/2014
JP 2017-204408 A 11/2017
JP 2018-028990 A 2/2018
JP 2018-081884 A 5/2018
JP 2018-081894 A 5/2018

* cited by examiner

CONNECTOR DEVICE

CROSS REFERENCE TO RELATED APPLICATIONS

This application is based on and claims priority under 35 U.S.C. § 119 to Japanese Patent Application No. JP2017-157997 filed Aug. 18, 2017, the content of which is incorporated herein in its entirety by reference.

BACKGROUND OF THE INVENTION

This invention relates to a connector device, for example, relates to a connector device which is attached to an electric car or a hybrid car to transmit electric power supplied from a power system.

This type of connector is disclosed in JP 2014-238929A (Patent Document 1), the content of which is incorporated herein by reference.

As shown in FIG. 21, Patent Document 1 discloses a connector device 90 which comprises a first connector (connector) 910 and a second connector (mating connector) 950. The connector 910 comprises a first housing (housing) 920 which holds a power terminal (not shown), a first detection housing (sub-housing) 930 which holds a detection terminal (not shown) and an operation member 940. The mating connector 950 comprises a second housing (mating housing) 960. The mating housing 960 holds a mating power terminal (not shown) connected to a power cable 982 and a mating detection terminal (not shown) connected to a detection signal cable 984.

The operation member 940 is formed with a first cam groove 942, a second cam groove 944 and a guide channel 948. The housing 920 has a guide projection 928, and the sub-housing 930 has a second cam projection 934. The mating housing 960 has a first cam projection (not shown).

Under a state shown in FIG. 21, the first cam projection (not shown) of the mating housing 960 is received in the first cam groove 942 of the operation member 940, and the guide projection 928 of the housing 920 is received in the guide channel 948 of the operation member 940. When the operation member 940 is turned down under this state, the housing 920 is moved downward, and the power terminal (not shown) of the connector 910 is connected to the mating power terminal (not shown) of the mating connector 950. Meanwhile, the second cam projection 934 of the sub-housing 930 is received in the second cam groove 944 of the operation member 940. When the operation member 940 is subsequently slid leftward, the sub-housing 930 is moved downward, and the detection terminal (not shown) of the connector 910 is connected to the mating detection terminal (not shown) of the mating connector 950. As a result, the connector device 90 transmits electric power supplied from a power system (not shown).

According to Patent Document 1, a cam mechanism including the second cam groove and the second cam projection is necessary in order to move the sub-housing relative to the mating housing. Such cam mechanism makes the structure of the connector complicated. Moreover, the operation member is required to have a part in which the second cam groove is formed, and the mating housing is required to have a space within which the sub housing is moved. Therefore, each of the connector and the mating connector might become large.

SUMMARY OF THE INVENTION

It is therefore an object of the present invention to provide a connector comprising a sub-housing which is movable relative to a mating housing with no cam mechanism.

An aspect of the present invention provides a connector device comprising a connector and a mating connector mateable with each other. The connector comprises a housing, a power terminal, a sub-housing and a detection terminal. The power terminal is held by the housing. The detection terminal is held by the sub-housing. The sub-housing is supported by the housing and is movable relative to the housing. The mating connector comprises a mating housing, a mating power terminal and a mating detection terminal. The mating power terminal and the mating detection terminal are held by the mating housing. The housing is formed with an axis portion. The mating housing is formed with a mating axis portion. One of the axis portion and the mating axis portion is a shaft, and a remaining one of the axis portion and the mating axis portion is a bearing. The shaft extends in an axial direction. Under a state where the shaft and the bearing are combined with each other, the housing is turnable about the shaft relative to the mating housing. A turn of the housing relative to the mating housing changes a state of the connector between an unconnected state and a connected state via an intermediate state. When the connector takes the unconnected state, the power terminal is unconnected to the mating power terminal, and the detection terminal is unconnected to the mating detection terminal. When the connector takes the intermediate state, the power terminal is connected to the mating power terminal, but the detection terminal is unconnected to the mating detection terminal. When the connector takes the connected state, the power terminal is connected to the mating power terminal, and the detection terminal is connected to the mating detection terminal. The sub-housing has a guided portion. The mating housing has a guide portion. While the state of the connector is changed from the intermediate state to the connected state, the guide portion guides the guided portion to move the sub-housing relative to the housing, so that the detection terminal is moved downward along an upper-lower direction perpendicular to the axial direction to be connected to the mating detection terminal.

According to an aspect of the present invention, the sub-housing which holds the detection terminal is movable relative to the turnable housing. While the state of the connector is changed from the intermediate state to the connected state in accordance with the turn of the housing, the guide portion guides the guided portion to move the sub-housing relative to the housing. As a result, the detection terminal is moved downward along the upper-lower direction to be connected to the mating detection terminal. According to an aspect of the present invention, the sub-housing is movable relative to the mating housing with no cam mechanism.

An appreciation of the objectives of the present invention and a more complete understanding of its structure may be had by studying the following description of the preferred embodiment and by referring to the accompanying drawings.

Figure 1:
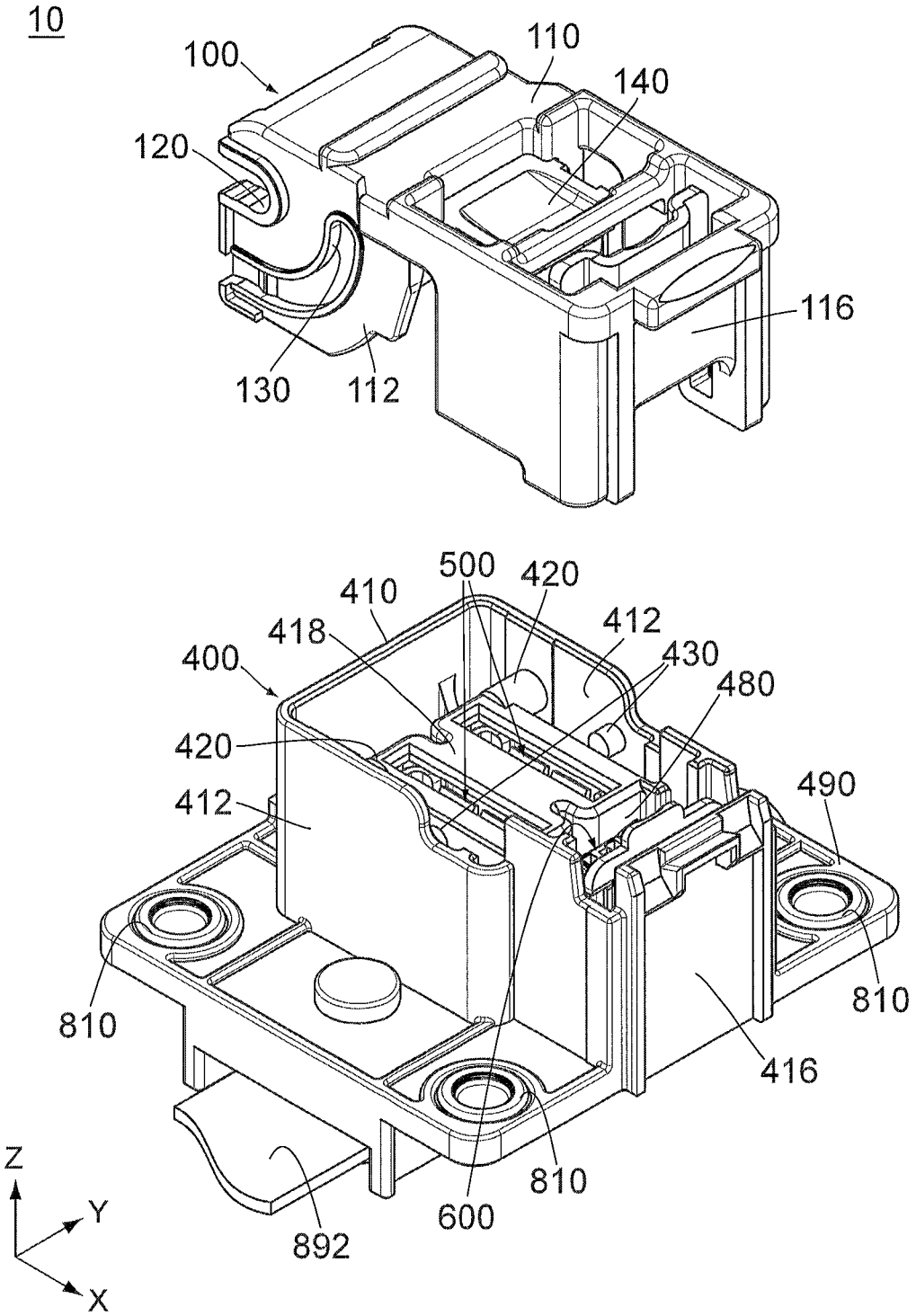
FIG. 1 is a perspective view showing a connector and a mating connector of a connector device according to an embodiment of the present invention, wherein the connector is apart from the mating connector, and the mating connector is connected to a busbar.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 15:
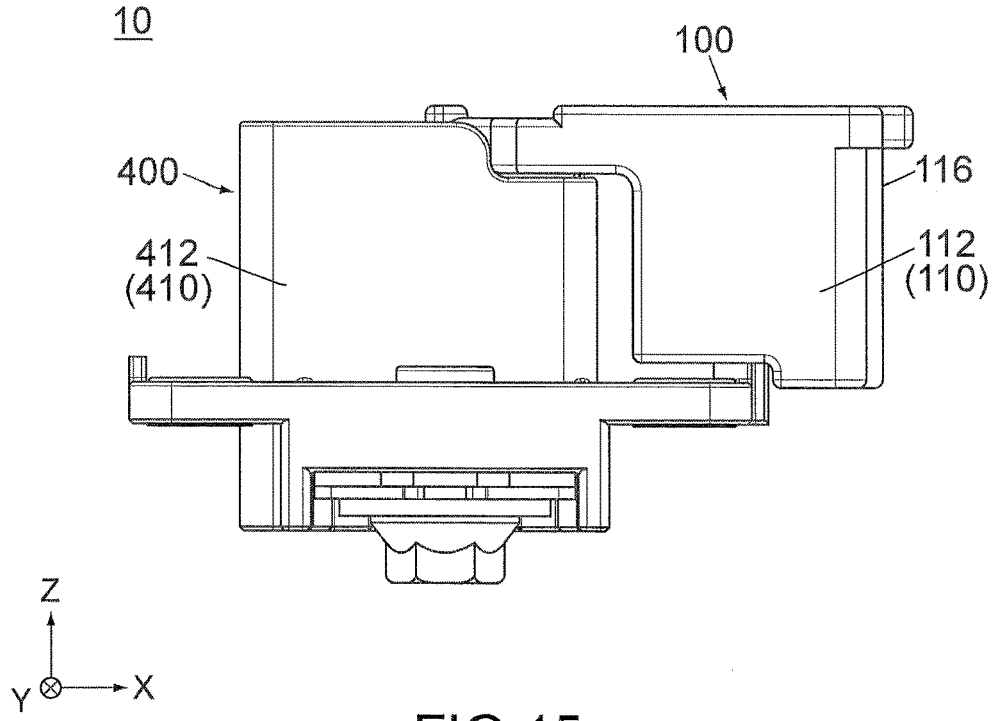
FIG. 15 is another side view showing the connector device of FIG. 7, wherein the connector takes a connected state.
Figure 16:
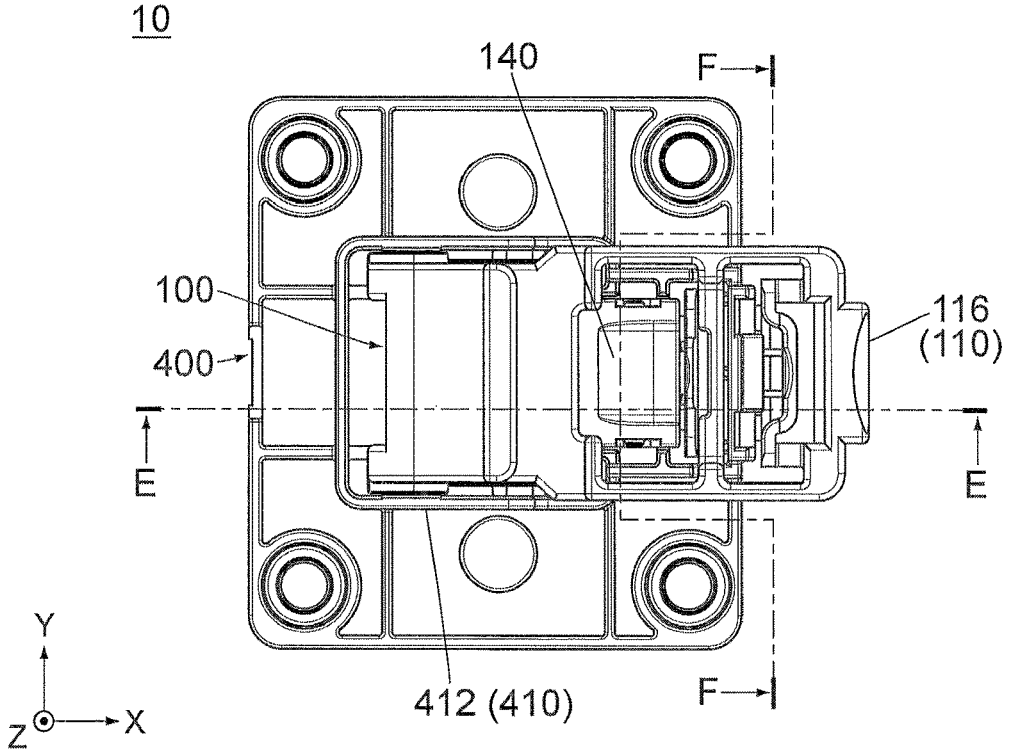
FIG. 16 is a top view showing the connector device of FIG. 15.

As shown in FIG. 1, a connector device 10 according to an embodiment of the present invention comprises a connector 100 and a mating connector 400. Referring to FIG. 15, the connector 100 and the mating connector 400 are mateable with each other. The mating connector 400 is attached to an object such as an electric car (not shown) and is connected between a power system (not shown) and a motor (not shown).

Hereafter, explanation is first made about a structure of the mating connector 400 and subsequently made about a structure of the connector 100.

Figure 5:
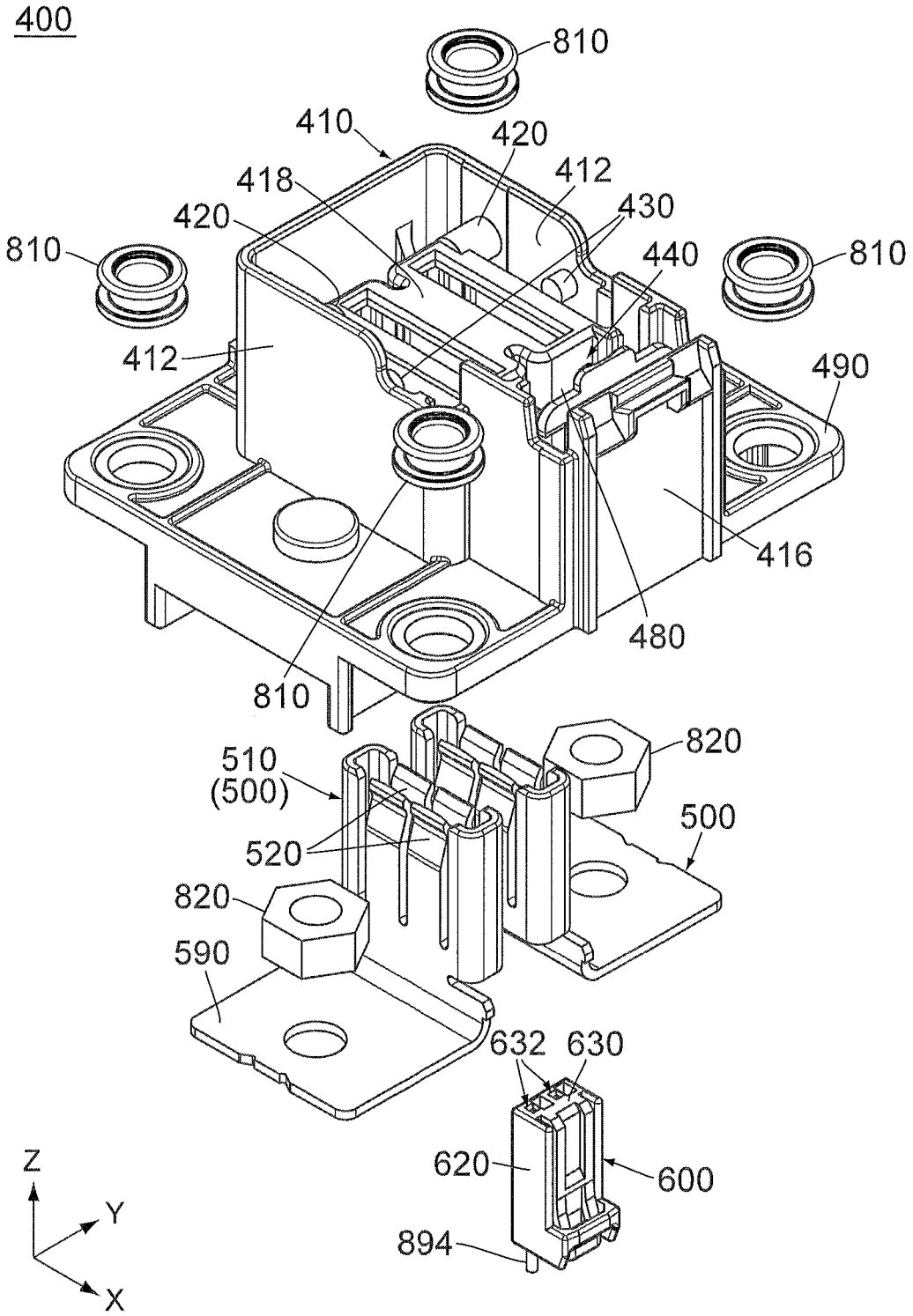
FIG. 5 is an exploded, perspective view showing the mating connector of FIG. 1, wherein mating detection terminals thereof are connected to signal cables, respectively, and held by a mating sub-housing.
Figure 18:
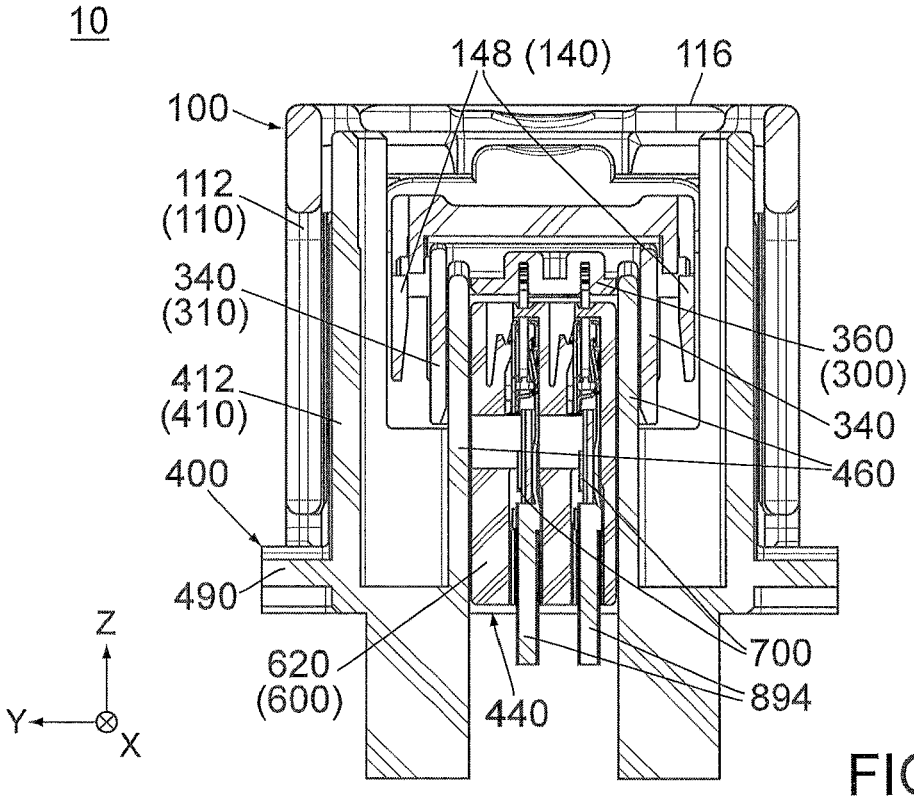
FIG. 18 is a cross-sectional view showing the connector device of FIG. 16, taken along line F-F.

Referring to FIGS. 5 and 18, the mating connector 400 comprises a mating housing 410 made of insulator, two mating power terminals 500 each made of metal, a mating sub-housing 600 made of insulator, two mating detection terminals 700 each made of metal, four eyelets 810 each made of elastomer and two nuts 820 each made of metal.

As shown in FIG. 5, the mating housing 410 has two sidewalls 412, a rear end portion 416, a holding portion 418 and a flange 490. The sidewalls 412 are located at opposite sides of the mating housing 410 in a lateral direction (Y-direction), respectively. Each of the sidewalls 412 extends along a first perpendicular plane (perpendicular plane: XZ-plane). The rear end portion 416 is located at a rear end, or the positive X-side end, of the mating housing 410 in a front-rear direction (X-direction). The rear end portion 416 extends along a second perpendicular plane (YZ-plane). The holding portion 418 is located at a middle part of the mating housing 410 in each of the X-direction and the Y-direction. The flange 490 is located at a lower end, or the negative Z-side end, of the mating housing 410 in an upper-lower direction (Z-direction). Referring to FIG. 1, the eyelets 810 are attached to the flange 490.

Referring to FIG. 5, the mating housing 410 is formed with two mating axis portions (shafts) 420 and two guided projections 430. The mating axis portions 420 are provided so as to correspond to the two sidewalls 412, respectively, and are located at positions same as each other in each of the X-direction and the Z-direction. Each of the mating axis portions 420 is a shaft extending in an axial direction in parallel to the Y-direction. Each of the mating axis portions 420 is located in the vicinity of a front end, or the negative X-side end, of the corresponding sidewall 412 and extends inward in the Y-direction to the holding portion 418. The guided projections 430 are provided so as to correspond to the two sidewalls 412, respectively, and are located at positions same as each other in each of the X-direction and the Z-direction. Each of the guided projections 430 is a projection projecting inward in the Y-direction. The guided projections 430 are located between the mating axis portions (shafts) 420 and the rear end portion 416 in the X-direction.

The mating power terminals 500 have shapes same as each other. Each of the mating power terminals 500 has a body portion 510 and a connection portion 590. The body portion 510 has a cylindrical shape extending in the Z-direction. The connection portion 590 extends outward in the Y-direction from a lower end of the body portion 510. The body portion 510 is provided with four contact points 520. Two of the contact points 520 face remaining two of the contact points 520 in the Y-direction, respectively. Each of the contact points 520 is supported by a spring portion to be movable in the Y-direction.

Figure 7:
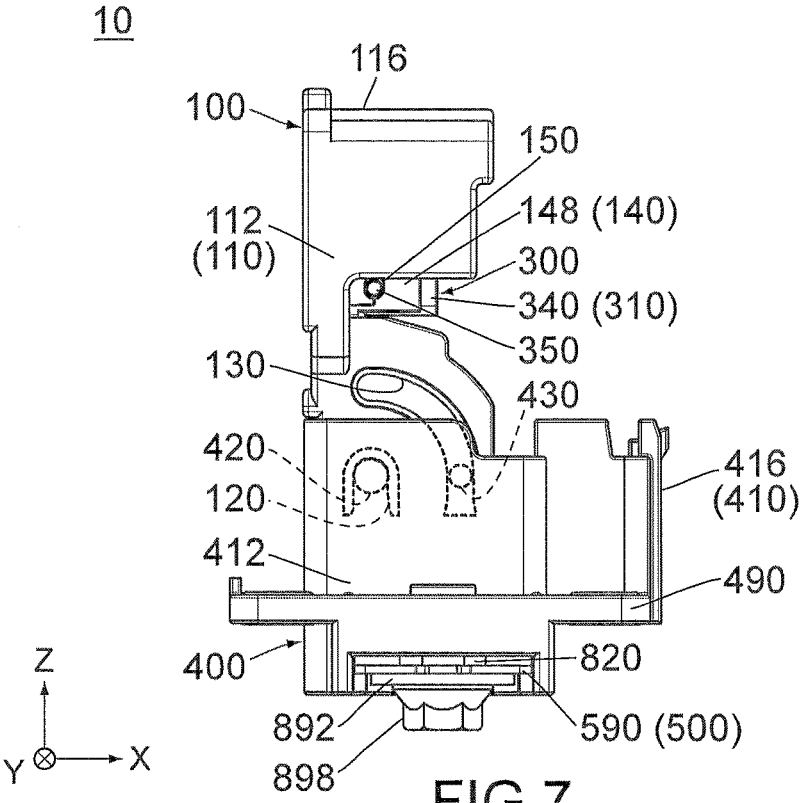
FIG. 7 is a side view showing the connector device of FIG. 1, wherein the connector takes an unconnected state, and hidden outlines of an axis portion, a guide recess, a mating axis portion and a guided projection are illustrated in dashed line.
Figure 8:
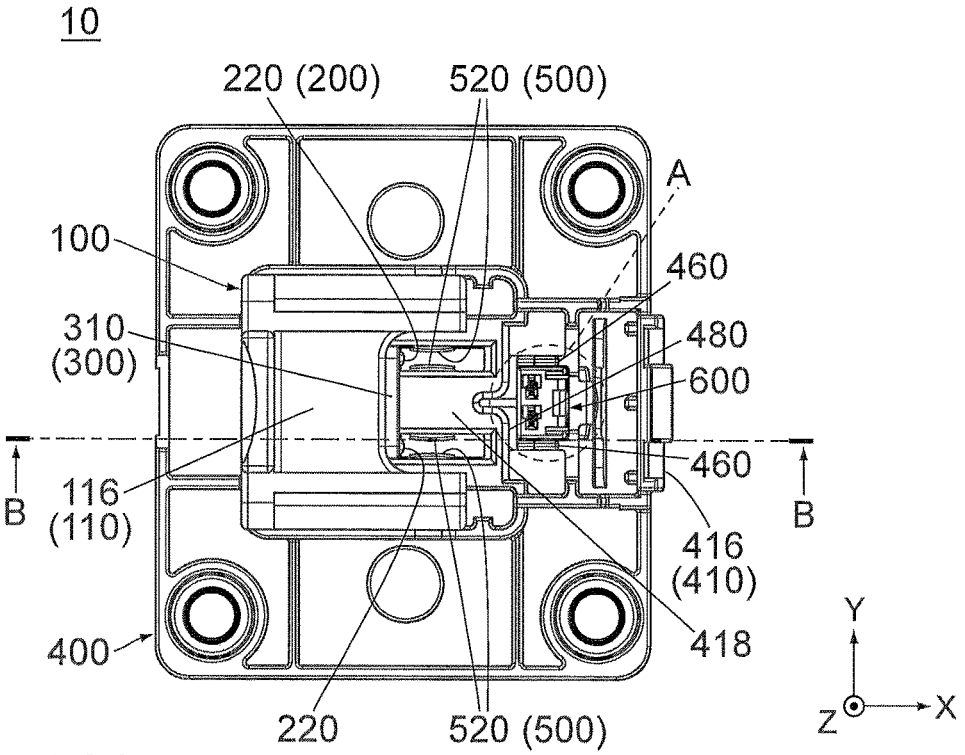
FIG. 8 is a top view showing the connector device of FIG. 7.

Referring to FIGS. 1, 5 and 8, the mating power terminals 500 are arranged mirror-symmetrically with respect to the XZ-plane. Moreover, the mating power terminals 500 are held inside the holding portion 418 of the mating housing 410 and fixed thereto. Thus, each of the mating power terminals 500 is held by the mating housing 410 and is unmovable relative to the mating housing 410. Referring to FIG. 7, each of the connection portions 590 of the mating power terminals 500 is connected to a busbar 892 by using a bolt 898 and the nut 820.

Figure 19:
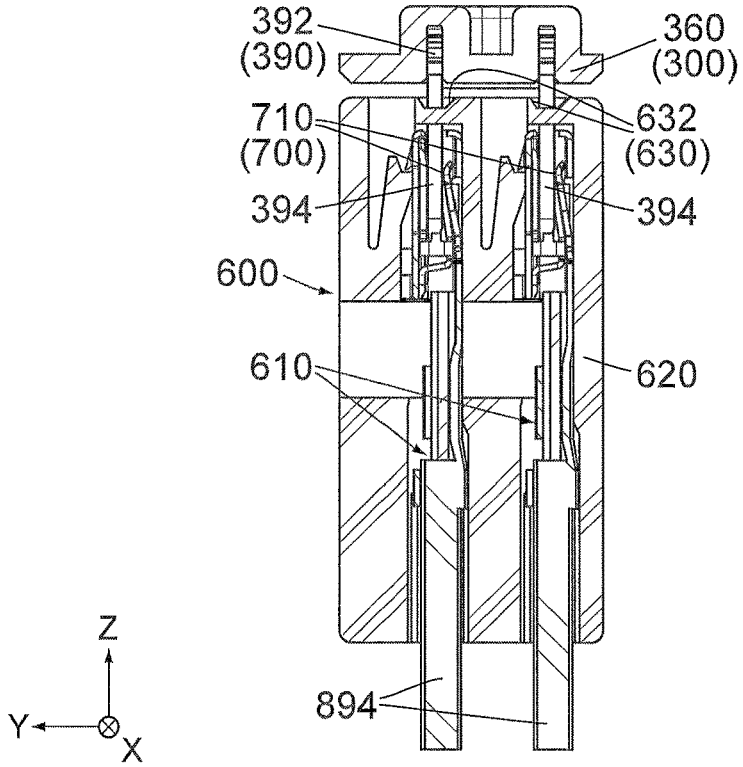
FIG. 19 is a cross-sectional view showing a part of the sub-housing and the mating sub-housing of the connector device of FIG. 18.

As shown in FIG. 5, the mating sub-housing 600 has a rectangular column shape extending in the Z-direction. Referring to FIG. 19, the mating sub-housing 600 has two holding holes 610 which are formed therewithin and arranged in the Y-direction. Each of the holding holes 610 extends along the Z-direction and opens downward, or in the negative Z-direction.

Referring to FIGS. 5 and 19, the mating sub-housing 600 has a peripheral wall 620 and a cover 630. The peripheral wall 620 encloses the holding holes 610 in a horizontal plane (XY-plane). The cover 630 is located at an upper end, or the positive Z-side end, of the mating sub-housing 600. The cover 630 is formed with two openings 632. Each of the openings 632 is a space enclosed by four sloping surfaces and is gradually narrowed downward. The openings 632 correspond to the two holding holes 610, respectively. Each of the openings 632 is connected to the corresponding holding hole 610 in the Z-direction. In other words, each of the holding holes 610 opens upward, or in the positive Z-direction, through the corresponding opening 632.

Figure 6:
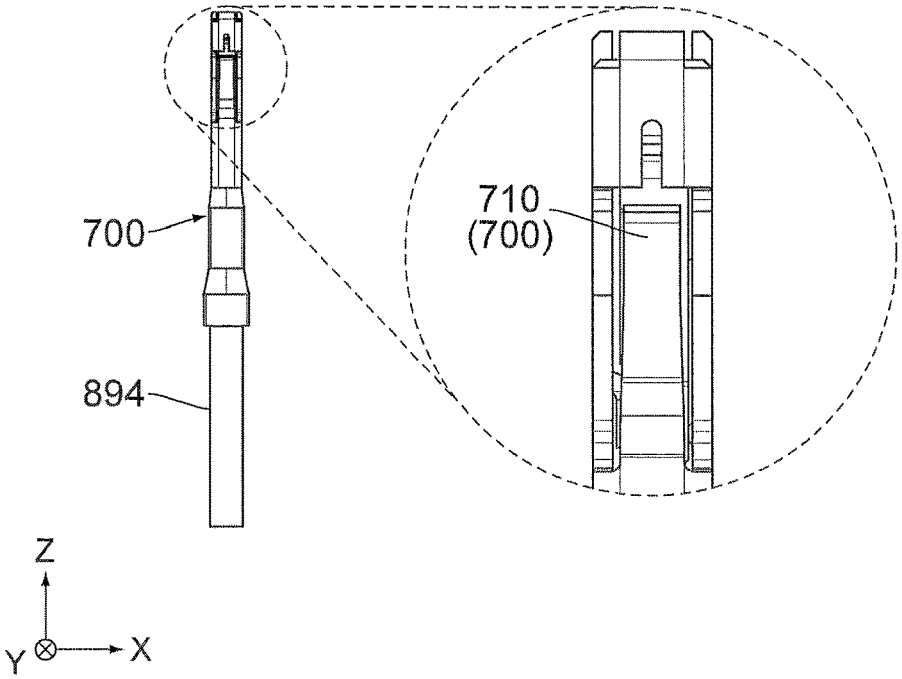
FIG. 6 is a side view showing the mating detection terminal of the mating connector of FIG. 5, wherein the mating detection terminal is connected to the signal cable, and a part of the mating detection terminal (part enclosed by dashed line) is enlarged to be illustrated.

Referring to FIGS. 6 and 19, the mating detection terminals 700 have shapes same as each other. Each of the mating detection terminals 700 has a mating contact portion 710. The mating contact portion 710 is located in the vicinity of an upper end of the mating detection terminal 700 and is supported by a spring portion to be movable in the Y-direction. Each of the mating detection terminals 700 has a lower end connected to a signal cable 894. Referring to FIG. 19, the mating detection terminals 700 are arranged in the same orientation in the Y-direction. Moreover, the mating detection terminals 700 are held inside the holding holes 610 of the mating sub-housing 600, respectively, to be fixed thereto. Thus, each of the mating detection terminals 700 is held by the mating sub-housing 600 and is unmovable relative to the mating sub-housing 600.

Referring to FIG. 5, the mating housing 410 is formed with a receiving portion 440. The receiving portion 440 is a space which is located rearward of the holding portion 418. Referring to FIG. 18, the mating sub-housing 600 is received in the receiving portion 440 and is held by the mating housing 410 to be unmovable. Therefore, each of the mating detection terminals 700 is held by the mating housing 410 via the mating sub-housing 600 and is unmovable relative to the mating housing 410.

In the present embodiment, the mating sub-housing 600 which holds the mating detection terminals 700 is a member separable from the mating housing 410. However, the present invention is not limited thereto, but the mating sub-housing 600 and the mating housing 410 may form a single member. More specifically, a part of the mating housing 410 may be formed to have a shape similar to that of the mating sub-housing 600 so that the mating detection terminals 700 are directly held by the mating housing 410.

Figure 9:
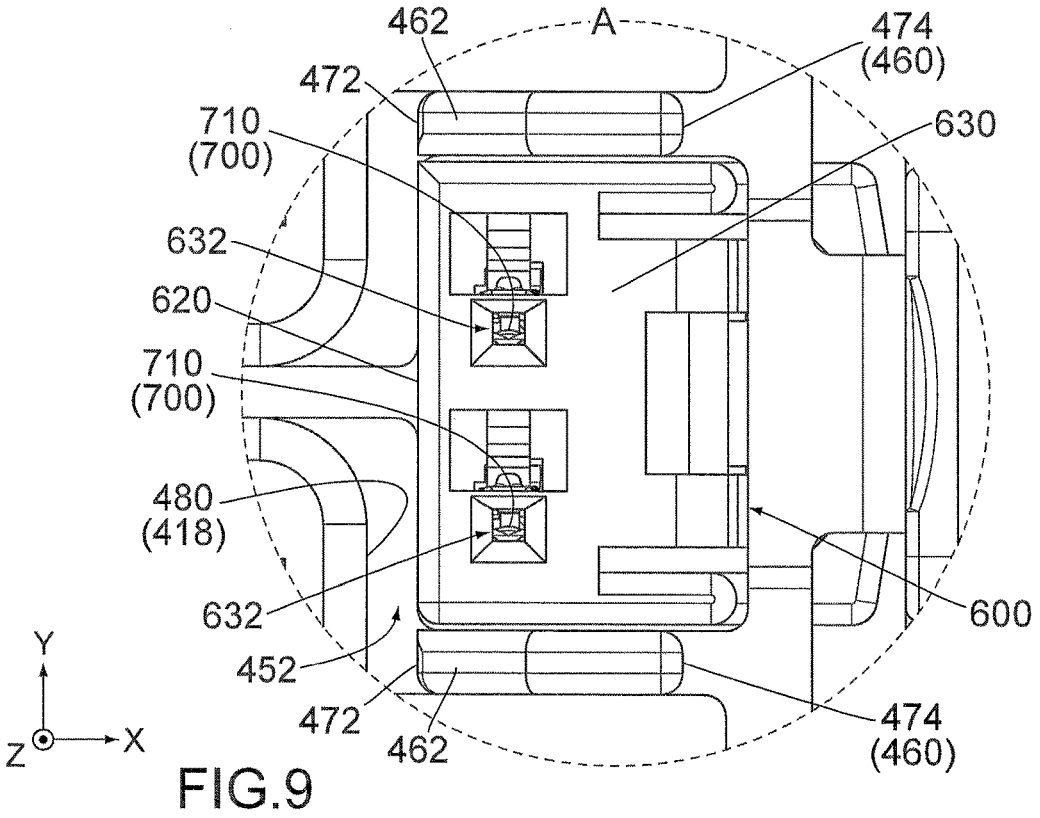
FIG. 9 is an enlarged, top view showing a part of the mating connector (part enclosed by dashed line A) of the connector device of FIG. 8.

Referring to FIGS. 9 and 19, the cover 630 of the mating sub-housing 600 covers the mating detection terminals 700 from above in the Z-direction. Nevertheless, the mating contact portions 710 of the mating detection terminals 700 are visible from above through the openings 632 of the cover 630. In the present embodiment, the cover 630 is a part of the mating sub-housing 600. However, the present invention is not limited thereto. For example, the cover 630 may be a part of the mating housing 410. In other words, the mating housing 410 may be provided with the cover 630 which covers the mating detection terminals 700 from above in the Z-direction.

Figure 10:
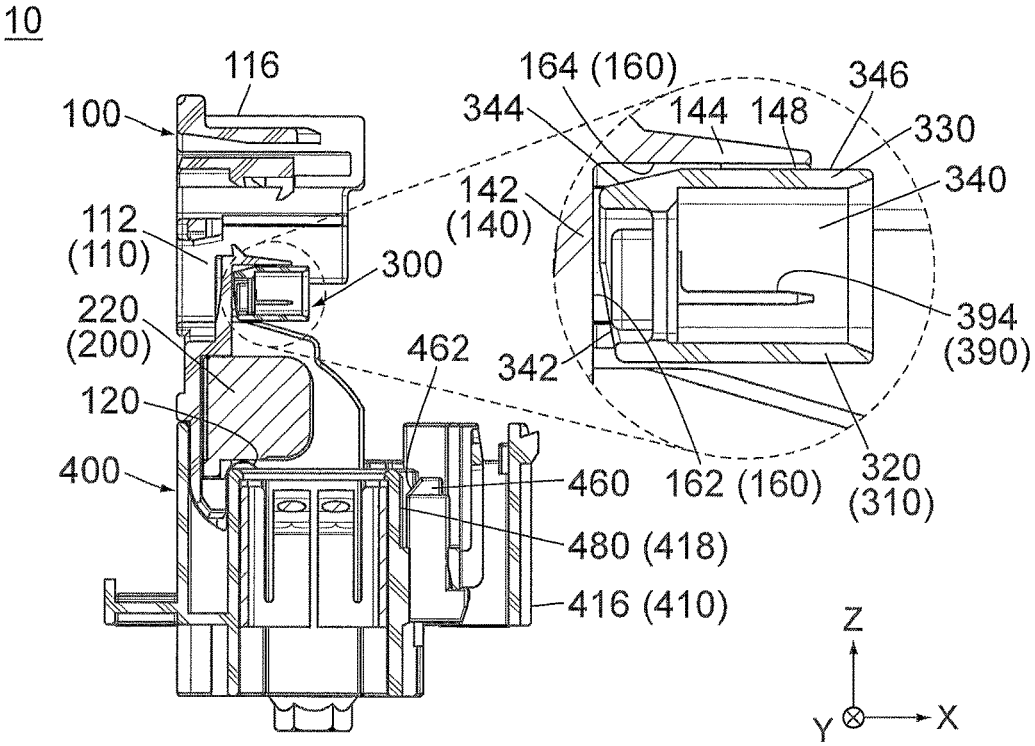
FIG. 10 is a cross-sectional view showing the connector device of FIG. 8, taken along line B-B, wherein a part of the connector (part enclosed by dashed line) is enlarged to be illustrated.

Referring to FIGS. 9, 10 and 18, the mating housing 410 has two partition walls 460. Each of the partition walls 460 has a flat-plate shape perpendicular to the Y-direction and extends in the Z-direction. The two partition walls 460 have shapes mirror symmetrical to each other with respect to the XZ-plane. The partition walls 460 are arranged in the Y-direction and sandwich the mating sub-housing 600 in the Y-direction.

Figure 13:
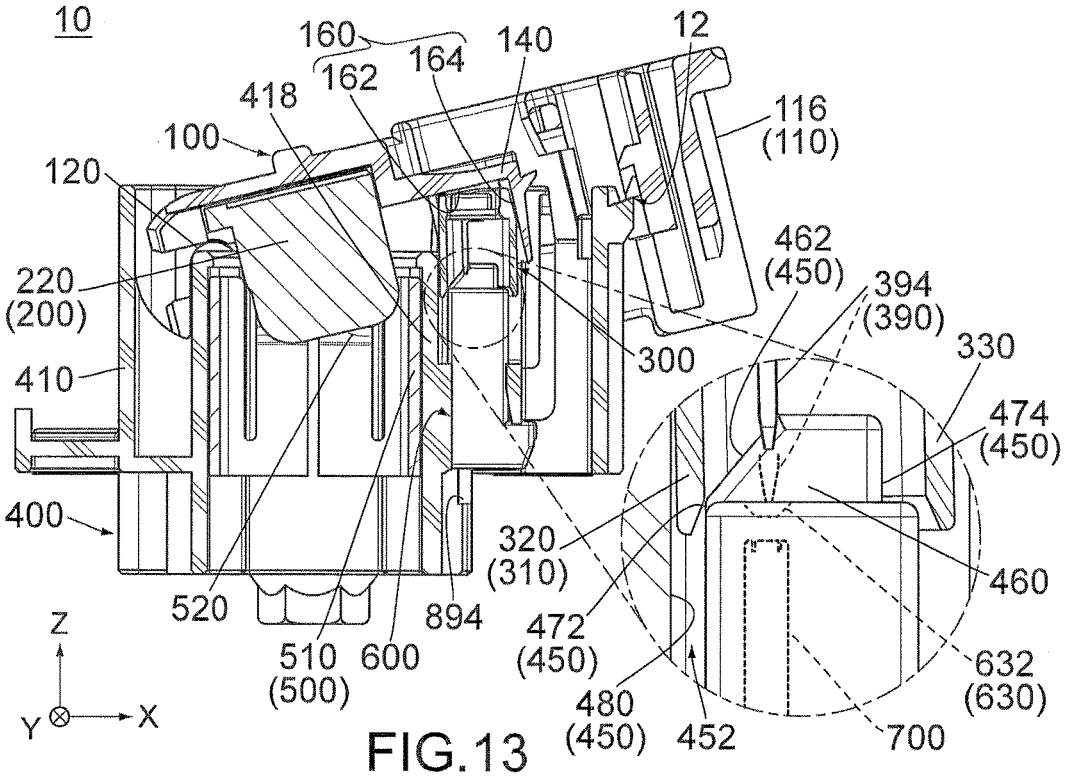
FIG. 13 is a cross-sectional view showing the connector device of FIG. 12, taken along line C-C, wherein a part of the connector (part enclosed by chain dotted line) is enlarged to be illustrated, and in the enlarged view, hidden outlines of an opening of the mating sub-housing and the mating detection terminal are illustrated in dashed line together with an end of the detection terminal which is moved to an upper end of the opening.

Referring to FIGS. 9 and 13, each of the partition walls 460 has a sloping surface 462, a first wall surface (first regulation portion) 472 and a second wall surface (second regulation portion) 474. Thus, the mating housing 410 has the two sloping surfaces 462, the two first wall surfaces 472 and the two second wall surfaces 474. The sloping surface 462 is a front part (negative X-side part) of an upper surface (positive Z-side surface) of the partition wall 460. The sloping surface 462 extends forward, or in the negative X-direction, while sloping downward. In other words, the sloping surface 462 is oblique to the Z-direction. The first wall surface 472 is a front surface, or the negative X-side surface, of the partition wall 460 and extends downward from a front end of the sloping surface 462 along the Z-direction. The second wall surface 474 is a rear surface, or the positive X-side surface, of the partition wall 460 and extends downward from a rear end of the upper surface of the partition wall 460 along the Z-direction.

Referring to FIGS. 1, 5 and 9, the mating housing 410 has a facing wall surface (second regulation portion) 480. The facing wall surface 480 is a rear surface of the holding portion 418. The facing wall surface 480 extends along the Z-direction while being curved in the XY-plane. Referring to FIGS. 9 and 13, the facing wall surface 480 faces the two first wall surfaces 472 across a guide channel 452 in the X-direction. Each of the first wall surfaces 472 is located rearward of the facing wall surface 480 across the guide channel 452 and is located at a position same as that of a front surface of the peripheral wall 620 of the mating sub-housing 600 in the X-direction. Therefore, the first wall surfaces 472 are located forward of the mating detection terminals 700. In contrast, the second wall surfaces 474 are located rearward of the mating detection terminals 700. The guide channel 452 is a space which extends in the Z-direction and opens upward. In the X-direction, the guide channel 452 is located between the facing wall surface 480 and a series of surfaces consisting of the two first wall surfaces 472 and the front surface of the peripheral wall 620.

Figure 2:
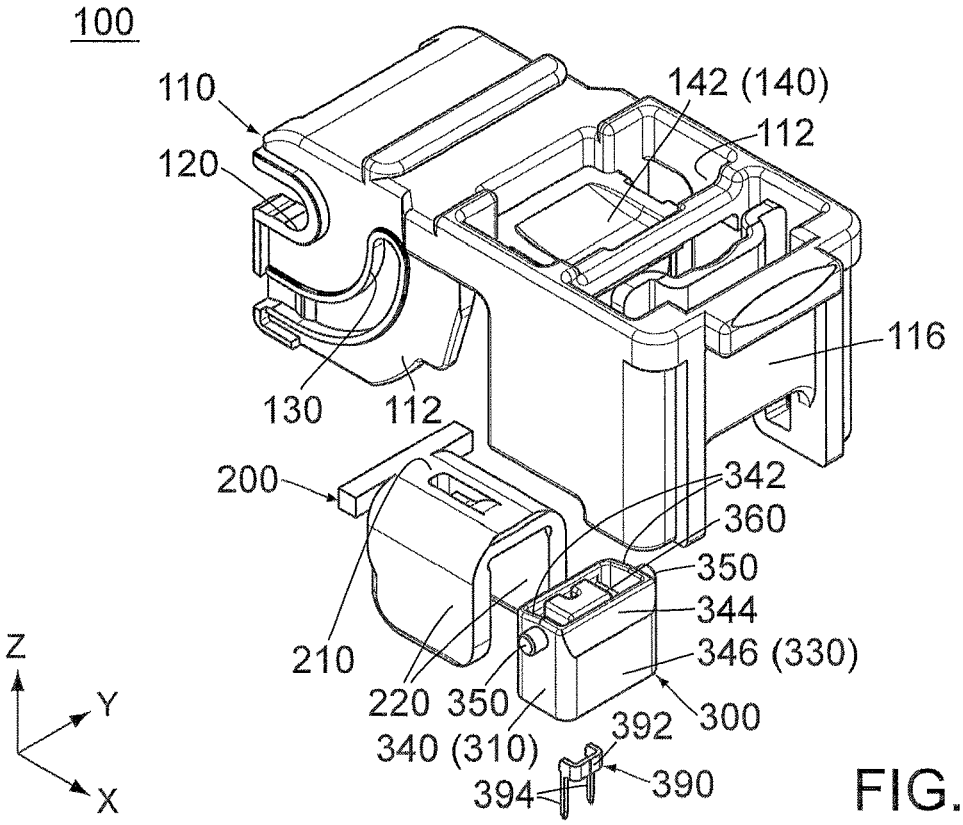
FIG. 2 is an exploded, perspective view showing the connector of FIG. 1.

Referring to FIG. 2, the connector 100 comprises a housing 110 made of insulator, a power terminal 200 made of metal, a sub-housing 300 made of insulator and a detection terminal 390 made of metal. The housing 110 has two side portions 112. The side portions 112 are located at opposite sides of the housing 110 in the Y-direction, respectively. Each of the side portions 112 extends along the XZ-plane.

Referring to FIGS. 2 and 7, the housing 110 is formed with two axis portions (bearings) 120 and two guide recesses 130. The axis portions 120 are provided so as to correspond to the two side portions 112, respectively. Each of the axis portions 120 is a bearing which is a hole passing through the corresponding side portion 112 in the Y-direction. The two axis portions 120 are located at positions same as each other in each of the X-direction and the Z-direction. The guide recesses 130 are provided so as to correspond to the two side portions 112, respectively. Each of the guide recesses 130 is a groove which is formed on the corresponding side portion 112 to be recessed inward in the Y-direction. Each of the guide recesses 130 has an arch-shape in the XZ-plane. The two guide recesses 130 are located at positions same as each other in each of the X-direction and the Z-direction.

Referring to FIGS. 1, 7, 11 and 15, under a combined state where the axis portions 120 and the mating axis portions 420 are combined with each other, the housing 110 is turnable about the shafts relative to the mating housing 410. According to the present embodiment, each of the axis portions 120 of the housing 110 is the bearing, and each of the mating axis portions 420 of the mating housing 410 is the shaft. Thus, the housing 110 of the present embodiment is turnable about the mating axis portions 420. However, the present invention is not limited thereto. For example, each of the axis portions 120 may be a shaft, and each of the mating axis portions 420 may be a bearing. As described above, one of the axis portion 120 and the mating axis portion 420 may be a shaft and a remaining one of the axis portion 120 and the mating axis portion 420 may be a bearing.

Figure 11:
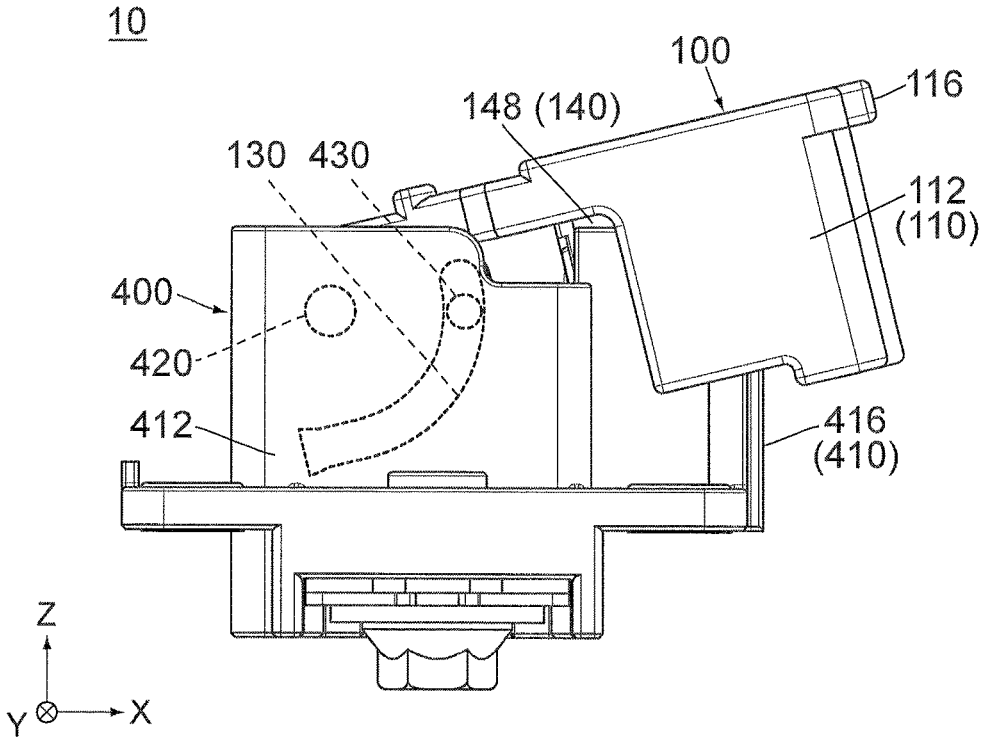
FIG. 11 is another side view showing the connector device of FIG. 7, wherein the connector takes an intermediate state, and a hidden outlines of the mating axis portion, the guide recess and the guided projection are illustrated in dashed line.
Figure 12:
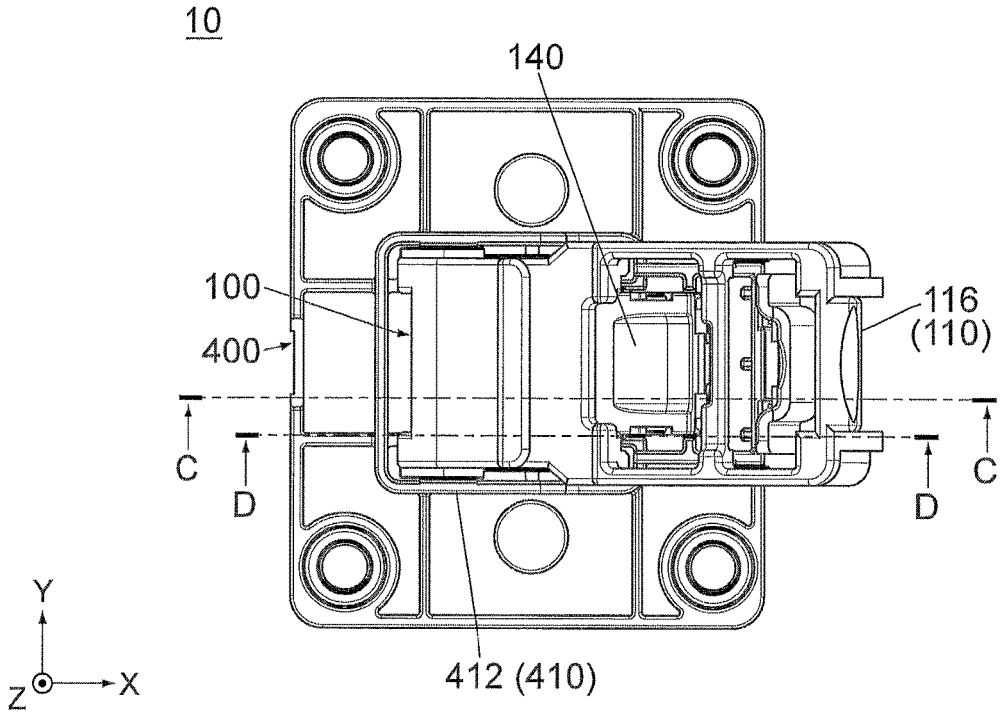
FIG. 12 is a top view showing the connector device of FIG. 11.

Referring to FIGS. 7, 11 and 15, each part of the connector 100 changes its position in the XZ-plane as the housing 110 is turned. The housing 110 is turned between an open position shown in FIG. 7 and a close position shown in FIG. 15 via an intermediate position shown in FIG. 11. In the following explanation, when necessary, a positional feature of each part of the connector 100 in the XZ-plane is specified by using "radial direction" and "circumference direction". In the following explanation, the radial direction is a direction along a radius of an imaginary circle around the axis portion 120 (see FIG. 1) in the XZ-plane, and the circumference direction is another direction along the circumference of the imaginary circle. In other words, each of the radial direction and the circumference direction is a direction about the shafts, or the axis portions 120 of the housing 110. Each of the radial direction and the circumference direction is perpendicular to the Y-direction. In addition, the radial direction and the circumference direction are perpendicular to each other.

Referring to FIG. 2, the housing 110 has a base portion 116 and an accommodation portion 140. The base portion 116 is a part which is farthest from the axis portions 120 in the radial direction. The base portion 116 extends along a plane perpendicular to the radial direction. The accommodation portion 140 is located between the axis portions 120 and the base portion 116 of the housing 110 in the radial direction. Referring to FIGS. 2, 7 and 10, the accommodation portion 140 has a first wall 142, a second wall 144 and two third walls 148. Referring to FIG. 10, the first wall 142 extends along a plane defined by the radial direction and the axial direction (Y-direction). In the accommodation portion 140, the second wall 144 is farthest from the axis portions 120 in the radial direction. The second wall 144 extends along a plane perpendicular to the radial direction. The third walls 148 are located at opposite sides of the accommodation portion 140 in the Y-direction, respectively. Each of the third walls 148 extends along the XZ-plane.

Figure 14:
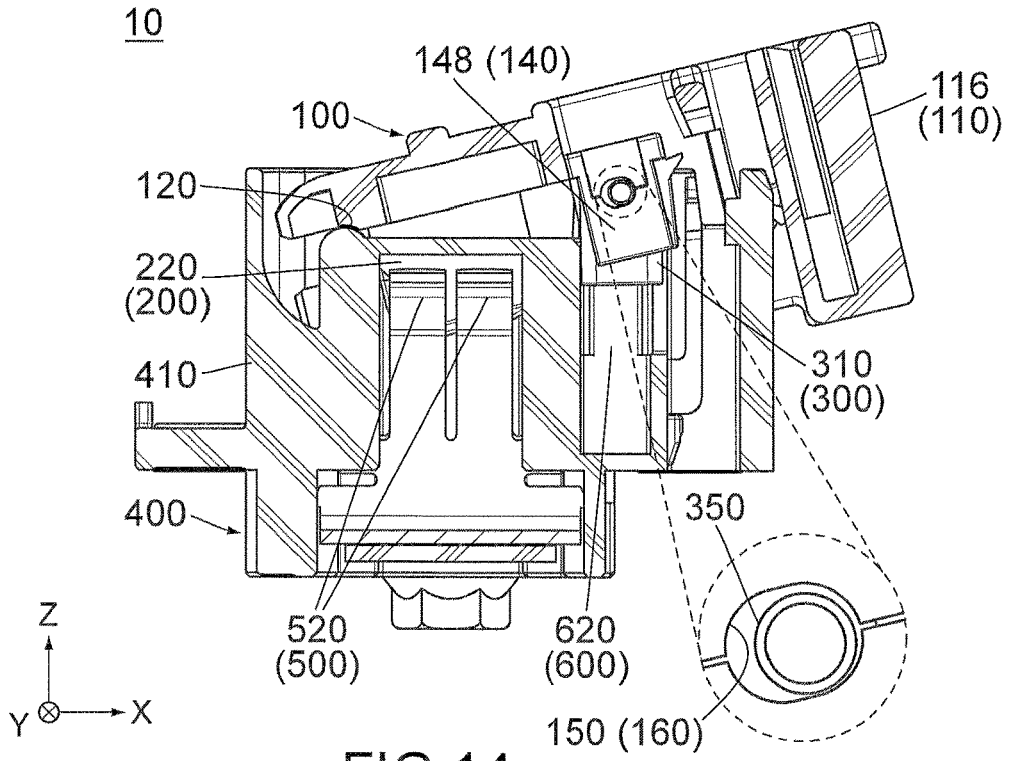
FIG. 14 is a cross-sectional view showing the connector device of FIG. 12, taken along line D-D, wherein a part of the connector (part enclosed by dashed line) is enlarged to be illustrated.

Referring to FIGS. 7 and 14, the housing 110 is formed with two sub-bearings 150. The sub-bearings 150 are provided so as to correspond to the two third walls 148, respectively. The two sub-bearings 150 are located at positions same as each other in each of the X-direction and the Z-direction. In the present embodiment, each of the sub-bearings 150 is a hole which passes through the corresponding third wall 148 in the Y-direction. However, the present invention is not limited thereto. For example, each of the sub-bearings 150 may be a recess which is formed on an inner wall surface of the corresponding third wall 148.

Referring to FIG. 10, the housing 110 has a first movement regulation portion 162 and a second movement regulation portion 164. The first movement regulation portion 162 is an inner wall surface of the first wall 142 of the accommodation portion 140. The first movement regulation portion 162 extends along a plane defined by the radial direction and the axial direction (Y-direction). The second movement regulation portion 164 is an inner wall surface of the second wall 144 of the accommodation portion 140. The second movement regulation portion 164 extends along a plane perpendicular to the radial direction. The first movement regulation portion 162 is located in a plane perpendicular to the second movement regulation portion 164. Moreover, the first movement regulation portion 162 is nearer to the axis portions 120 in the radial direction than the second movement regulation portion 164.

Referring to FIG. 2, the power terminal 200 has a coupling portion 210 and two blades 220. Each of the blades 220 extends along the XZ-plane. The coupling portion 210 couples the two blades 220 to each other in the Y-direction. Referring to FIGS. 2 and 10, the power terminal 200 is held by the housing 110 so that the blades 220 are arranged in the Y-direction. The power terminal 200 is fixed to the housing 110 and is unmovable relative to the housing 110.

Figure 3:
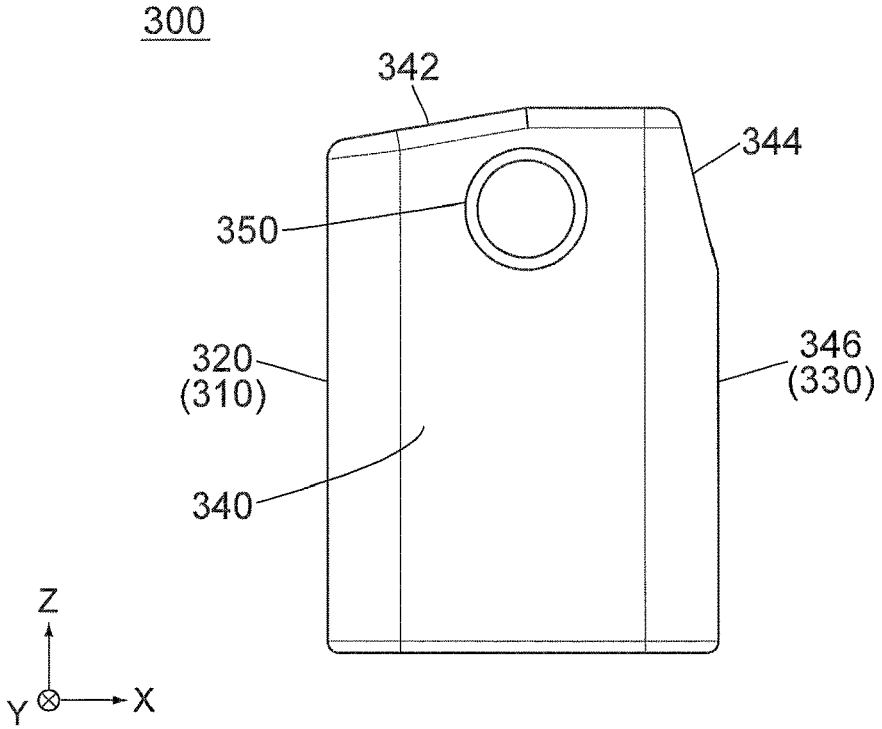
FIG. 3 is a side view showing a sub-housing of the connector of FIG. 2.
Figure 4:
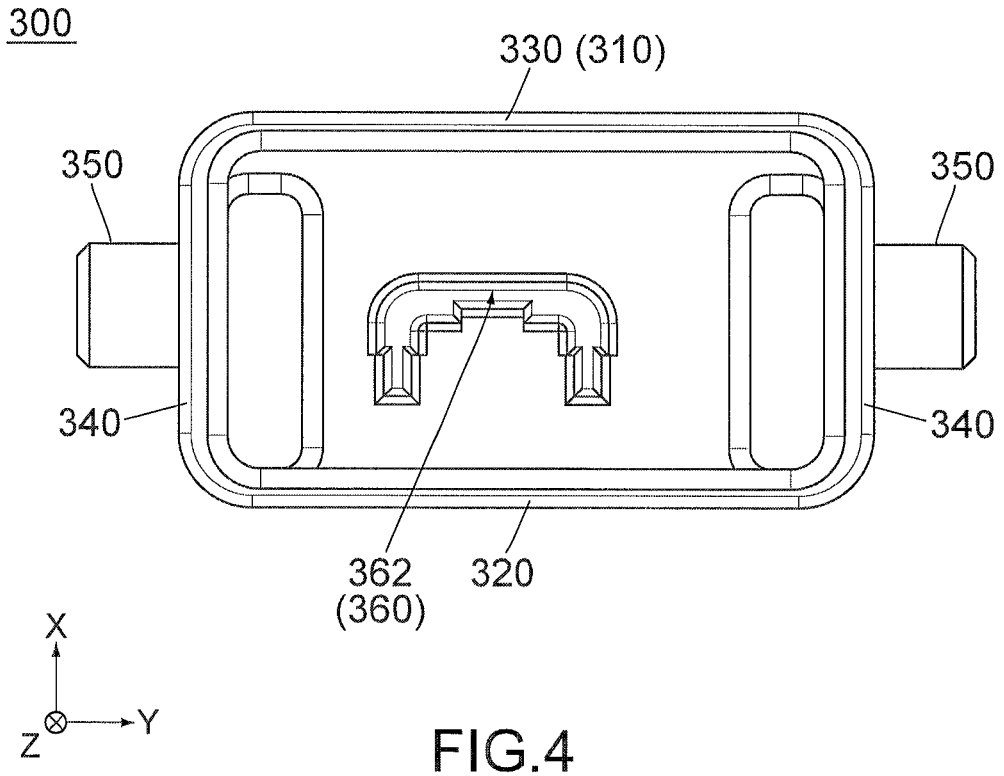
FIG. 4 is a bottom view showing the sub-housing of FIG. 3.

Referring to FIGS. 2 to 4, the sub-housing 300 has two side plates 340. The side plates 340 are located at opposite sides of the sub-housing 300 in the Y-direction, respectively. Each of the side plates 340 extends along the XZ-plane. The sub-housing 300 is formed with two sub-shafts 350. Each of the sub-shafts 350 is a shaft extending in parallel to the axial direction (Y-direction). The sub-shafts 350 are provided so as to correspond to the two side plates 340, respectively, and are located at positions same as each other in each of the X-direction and the Z-direction. Each of the sub-shafts 350 has a circular shape in the XZ-plane and projects outward in the Y-direction from the corresponding side plate 340.

Referring to FIGS. 7 and 10, the sub-housing 300 is partially accommodated inside the accommodation portion 140 of the housing 110. In detail, the sub-shafts 350 of the sub-housing 300 are inserted into the sub-bearings 150 of the accommodation portion 140, respectively, so that the two side plates 340 are sandwiched between the two third walls 148 of the accommodation portion 140 in the Y-direction to receive inward spring forces in the Y-direction from the third walls 148. The sub-housing 300 is supported by the housing 110. In particular, the sub-housing 300 is supported only by the sub-bearings 150 except for the aforementioned spring forces. In addition, a gap is formed between the sub-housing 300 and an inner wall surface of the accommodation portion 140 in the XZ-plane. Therefore, the sub-housing 300 is movable relative to the housing 110 to some extent. In other words, the sub-bearings 150 receive the sub-shafts 350, respectively, so that the sub-housing 300 is movable along the XZ-plane.

Referring to FIG. 14, each of the sub-bearings 150 is a long hole which extends long in the radial direction. Each of the circular sub-shafts 350 is movable inside the corresponding sub-bearing 150 along the radial direction and is rotatable clockwise and counterclockwise inside the corresponding sub-bearing 150. Therefore, the sub-housing 300 is slidable along the sub-bearings 150 relative to the housing 110 and is pivotally movable about the sub-shafts 350 relative to the housing 110 in each of opposite pivoting directions.

As described above, the sub-housing 300 is supported by the housing 110 so as to be movable relative to the housing 110. In particular, the sub-housing 300 of the present embodiment is swingingly movable along the XZ-plane but is almost unmovable in the Y-direction. However, the present invention is not limited thereto. For example, the sub-housing 300 may be only slidable along the sub-bearings 150. In this case, each of the sub-bearings 150 may extend along the radial direction longer than that of the present embodiment, and each of the sub-shafts 350 may have a rounded rectangular shape in the XZ-plane. Instead, the sub-housing 300 may be movable along the XZ-plane and movable in the Y-direction to some extent.

Figure 17:
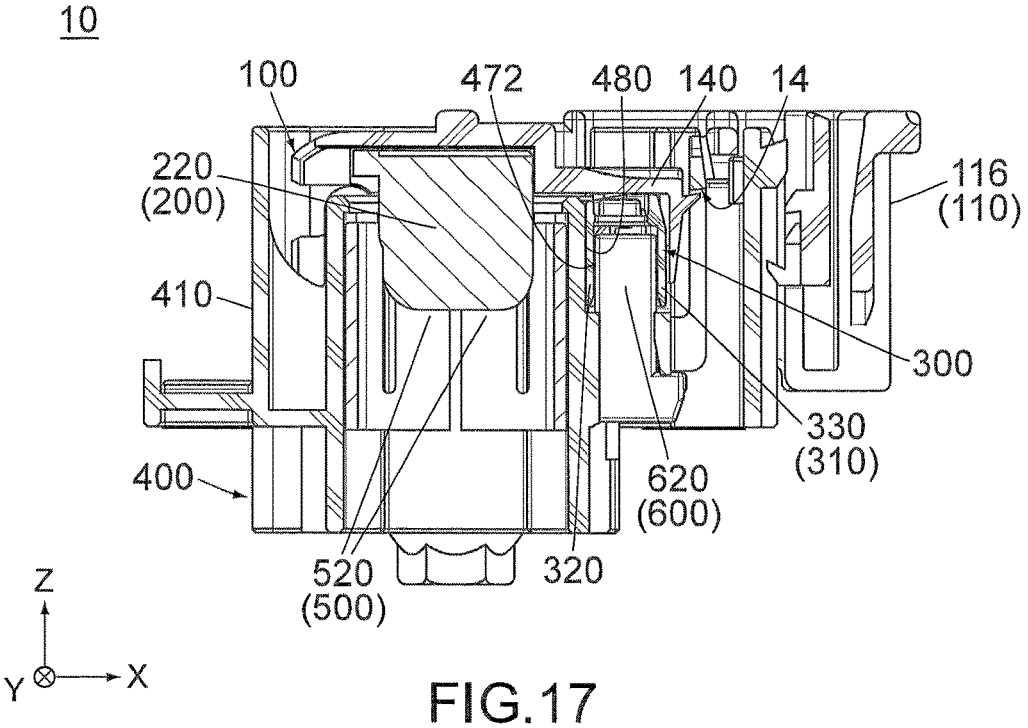
FIG. 17 is a cross-sectional view showing the connector device of FIG. 16, taken along line E-E.

Referring to FIGS. 10, 13 and 17, each part of the sub-housing 300 changes its position in the XZ-plane as the sub-housing 300 is moved relative to the housing 110 except when the housing 110 is located at the close position, or the position shown in FIG. 17. Hereafter, referring to FIGS. 2 to 4, explanation is first made about a structure of the sub-housing 300 and the detection terminal 390 under a state where the housing 110 is located at the close position. Subsequently, explanation is made, by using the radial direction and the circumference direction, about a structure of the sub-housing 300 which holds the detection terminal 390 and is supported by the housing 110.

Referring to FIGS. 2 to 4, the sub-housing 300 has a rectangular cylindrical portion 310 and a terminal holding portion 360. Under the illustrated state, the rectangular cylindrical portion 310 has a rectangular cylindrical shape which extends in the Z-direction and opens at a lower end thereof. The terminal holding portion 360 is located in the vicinity of an upper end of the rectangular cylindrical portion 310 and is enclosed by the rectangular cylindrical portion 310 in the XY-plane. Referring to FIG. 4, the terminal holding portion 360 is formed with a holding hole 362.

Referring to FIGS. 2 to 4, the sub-housing 300 has a front plate (guided portion) 320 and a rear plate 330 in addition to the side plates 340. In the present embodiment, each of the front plate 320, the rear plate 330 and the side plates 340 is a part of the rectangular cylindrical portion 310. In detail, under the illustrated state, the front plate 320 is a front wall of the rectangular cylindrical portion 310, and the rear plate 330 is a rear wall (positive X-side wall) of the rectangular cylindrical portion 310. The side plates 340 are two sidewalls of the rectangular cylindrical portion 310. However, the present invention is not limited thereto. For example, the sub-housing 300 may have no side plate 340. In this case, the sub-shafts 350 may be provided on the terminal holding portion 360.

Referring to FIGS. 2 and 3, the sub-housing 300 has two first movement regulated portions 342, a first movement regulated portion 344 and a second movement regulated portion 346. The first movement regulated portions 342 are provided so as to correspond to the two side plates 340, respectively, and are located at positions same as each other in each of the X-direction and the Z-direction. Under the illustrated state, each of the first movement regulated portions 342 is a front part of an upper edge of the corresponding side plate 340 and is oblique to both the X-direction and the Z-direction. More specifically, each of the first movement regulated portions 342 extends forward while sloping downward. The first movement regulated portion 344 is a part of a rear surface of the rear plate 330 which is located in the vicinity of an upper end thereof and is oblique to both the X-direction and the Z-direction. More specifically, the first movement regulated portion 344 extends rearward, or in the positive X-direction, while sloping downward. The second movement regulated portion 346 is a lower part of the rear surface of the rear plate 330 which is located below the first movement regulated portion 344 and is perpendicular to the X-direction.

As shown in FIG. 2, the detection terminal 390 has a held portion 392 and two contact portions 394. The held portion 392 couples the two contact portions 394 to each other in the Y-direction. Under the illustrated state, each of the contact portions 394 linearly extends downward from the held portion 392.

Referring to FIGS. 2 and 4, the held portion 392 is press-fit into and held by the holding hole 362 of the sub-housing 300. Thus, the detection terminal 390 is held by the sub-housing 300 so that the contact portions 394 are arranged in the Y-direction. The detection terminal 390 is fixed to the sub-housing 300 and is unmovable relative to the sub-housing 300.

Referring to FIGS. 10 and 13, under a state where the sub-housing 300 is supported by the housing 110, regardless of the position of the housing 110, the front plate 320 of the rectangular cylindrical portion 310 is nearer to the axis portions 120 in the radial direction than the detection terminal 390 and any other part of the rectangular cylindrical portion 310. In contrast, the rear plate 330 of the rectangular cylindrical portion 310 is farther from the axis portions 120 in the radial direction than the detection terminal 390 and any other part of the rectangular cylindrical portion 310.

Referring to FIG. 10, each of the first movement regulated portions 342 of the sub-housing 300 is located in a plane intersecting with each of the first movement regulated portion 344 and the second movement regulated portion 346. Moreover, each of the first movement regulated portions 342 is nearer to the axis portions 120 in the radial direction than the first movement regulated portion 344 and the second movement regulated portion 346.

Hereafter, explanation is made about a mating operation in which the connector 100 is operated to be mated with the mating connector 400 and a removal operation in which the connector 100 is operated to be removed from the mating connector 400.

Referring to FIGS. 7, 11 and 15, as previously described, when the axis portions 120 and the mating axis portions 420 are combined with each other, the housing 110 is turnable about the shafts, or the mating axis portions 420, between the open position, or the position shown in FIG. 7, and the close position, or the position shown in FIG. 11, via the intermediate position, or the position shown in FIG. 15. In the following explanation, a state which the connector 100 takes when the housing 110 is located at the open position is referred to as "unconnected state", and a state which the connector 100 takes when the housing 110 is located at the close position is referred to as "connected state". In addition, a state which the connector 100 takes when the housing 110 is located at the intermediate position is referred to as "intermediate state". Thus, a turn of the housing 110 relative to the mating housing 410 changes the state of the connector 100 between the unconnected state and the connected state via the intermediate state.

In the following explanation, when necessary, a positional feature of each part of the connector device 10 in the XZ-plane is specified by using a radial direction and a circumference direction about the mating axis portions 420. The radial direction is a direction along a radius of an imaginary circle around the mating axis portions 420 in the XZ-plane, and the circumference direction is another direction along a circumference of the imaginary circle in the XZ-plane. In addition, in the following explanation, each of "clockwise turn" and "counterclockwise turn" specifies a turning direction of the connector 100 of the connector device 10 that is seen along the positive Y-direction.

Referring to FIGS. 1 and 7 to 10, the connector 100, which is in a standing posture relative to the mating connector 400, is attached to the mating connector 400 along the negative Z-direction from above the mating connector 400. This operation changes the state of the connector 100 from a separated state, in which the connector 100 is apart from the mating connector 400 as shown in FIG. 1, to the unconnected state in which the connector 100 is partially mated with the mating connector 400 as shown in FIGS. 7 to 10.

As shown in FIG. 10, when the connector 100 takes the unconnected state, the power terminal 200 is unconnected to the mating power terminals 500. As can be seen from FIGS. 10 and 13, under the unconnected state, the detection terminal 390 is unconnected to the mating detection terminals 700.

Referring to FIGS. 7 and 11 to 14, when the housing 110 is turned clockwise about the mating axis portions 420 along the circumference direction, the guided projections 430 are moved in the guide recesses 130, respectively, so that a part of the connector 100 that is located between the axis portions 120 and the base portion 116 is moved clockwise. As a result, the state of the connector 100 is changed from the unconnected state shown in FIG. 7 to the intermediate state shown in FIGS. 11 to 14, and the connector 100 is temporarily maintained in the intermediate state by a temporal regulation mechanism 12 (see FIG. 13) provided to the connector device 10.

Referring to FIG. 13, when the connector 100 takes the intermediate state, the power terminal 200 is connected to the two mating power terminals 500 so that the mating power terminals 500 are connected with each other. In detail, each of the blades 220 of the power terminal 200 is inserted inside the body portion 510 of the corresponding mating power terminal 500, to be sandwiched between the contact points 520 in the Y-direction and to be in contact with the contact points 520. Under the intermediate state, the detection terminal 390 is unconnected to the mating detection terminals 700 so that the two signal cables 894 (see FIG. 18) are unconnected with each other. As a result, the power system (not shown) makes control so that electric current does not flow through the busbar 892 (see FIG. 1).

Referring to FIGS. 11 and 15 to 18, when the regulation of the temporal regulation mechanism 12 (see FIG. 13) is released and the housing 110 is turned clockwise along the circumference direction, the state of the connector 100 is changed from the intermediate state shown in FIG. 11 to the connected state shown in FIGS. 15 to 18. Referring to FIGS. 15 and 17, when the connector 100 takes the connected state, the housing 110 is located at the close position and cannot be turned clockwise beyond the close position. At that time, a maintenance mechanism 14 (see FIG. 17) provided to the connector device 10 prevents a counterclockwise turn of the housing 110 and maintains the connected state of the connector 100.

Referring to FIG. 17, when the connector 100 takes the connected state, the power terminal 200 is connected to the two mating power terminals 500. Referring to FIG. 19, under the connected state, the contact portions 394 of the detection terminal 390 pass through the openings 632 along the Z-direction, respectively, and are in contact with the mating contact portions 710 of the mating detection terminals 700, respectively. Thus, the detection terminal 390 is connected to the two mating detection terminals 700 so that the mating detection terminals 700 are connected with each other.

Referring to FIG. 17, under the connected state, the sub-housing 300 is completely mated with the mating sub-housing 600, so that the connector 100 is completely mated with the mating connector 400. Under the connected state, the power system (not shown) makes control so that electric current flows through the busbar 892 (see FIG. 1). Thus, when the connector 100 is completely mated with the mating connector 400, the connector device 10 connects the power system and the motor (not shown) with each other so that the power system supplies electric current to the motor.

Referring to FIGS. 10, 13 and 17, when the maintenance of the maintenance mechanism 14 (see FIG. 17) is released and the housing 110 is turned counterclockwise along the circumference direction, the state of the connector 100 is changed from the connected state shown in FIG. 17 to the unconnected state shown in FIG. 10 via the intermediate state shown in FIG. 13.

Referring to FIGS. 13 and 17, when the state of the connector 100 is changed from the connected state to the intermediate state, the power terminal 200 is kept to be connected to the mating power terminals 500. In contrast, while the state of the connector 100 is thus-changed, the detection terminal 390 is disconnected from the mating detection terminals 700. As a result, the power system (not shown) makes control so that the electric current supplied to the busbar 892 (see FIG. 1) is stopped. Referring to FIGS. 10 and 13, while the state of the connector 100 is changed from the intermediate state to the unconnected state, the power terminal 200 is disconnected from the mating power terminals 500. Referring to FIG. 10, when the connector 100 takes the unconnected state, the connector 100 is movable upward and is removable from the mating connector 400.

As described above, the state of the connector 100 according to the present embodiment is changed between the unconnected state and the connected state via the intermediate state. Referring to FIG. 13, the intermediate state of the present embodiment can be defined as a temporarily maintained state of the connector 100 in which the state of the connector 100 is temporarily maintained by the temporal regulation mechanism 12. However, the intermediate state is not limited to the temporarily maintained state. Referring to FIGS. 10 and 13, the power terminal 200 is already connected to the mating power terminals 500 when the housing 110 is turned to the position of FIG. 13. In other words, the power terminal 200 starts to be connected to the mating power terminals 500 while the housing 110 is turned from the open position of FIG. 10 to the intermediate position of FIG. 13. For example, the intermediate state may be defined as a state of the connector 100 at a timing when the power terminal 200 starts to be connected to the mating power terminals 500. Moreover, referring to FIGS. 13 and 17, each of the temporal regulation mechanism 12 and the maintenance mechanism 14 may be provided as necessary.

Referring to FIG. 13, the mating housing 410 has a guide portion 450. As described later, the guide portion 450 guides the sub-housing 300, which is movable relative to the turnable housing 110, and linearly moves the sub-housing 300 along the Z-direction. Referring to FIGS. 10 and 14, the housing 110 has a movement regulation portion 160. The movement regulation portion 160 regulates a movement of the sub-housing 300 and defines a movable range of the sub-housing 300. Hereafter, explanation is first made about the movement regulation portion 160 and subsequently made about the guide portion 450.

Referring to FIG. 10, the movement regulation portion 160 of the housing 110 includes the first movement regulation portion 162 and the second movement regulation portion 164 which are previously described. For example, when the housing 110 and the sub-housing 300 are located at the positions shown in FIG. 10, the first movement regulation portion 162 faces the first movement regulated portions 342 with a slight gap therebetween in the circumference direction. In addition, the second movement regulation portion 164 faces the first movement regulated portion 344 and the second movement regulated portion 346 with a slight gap therebetween in the radial direction.

Referring to FIGS. 10 and 13, the first movement regulation portion 162 regulates a pivoting movement of the first movement regulated portions 342 about the sub-shafts 350 (see FIG. 14) in a first direction, or a clockwise direction in FIG. 10, when the state of the connector 100 is between the unconnected state and the intermediate state. In addition, the second movement regulation portion 164 regulates a pivoting movement of the first movement regulated portion 344 in the first direction. More specifically, the sub-housing 300 is pivotally movable about the sub-shafts 350 to a first limit position in the first direction. The first limit position is a position at which the first movement regulated portion 342 is brought into contact with the first movement regulation portion 162 or at which the first movement regulated portion 344 is brought into contact with the second movement regulation portion 164. The sub-housing 300 cannot be pivotally moved beyond the first limit position.

The second movement regulation portion 164 regulates a pivoting movement of the second movement regulated portion 346 about the sub-shafts 350 (see FIG. 14) in a second direction, or a counterclockwise direction in FIG. 10, when the state of the connector 100 is between the unconnected state and the intermediate state. More specifically, the sub-housing 300 is pivotally movable about the sub-shafts 350 in the second direction to a second limit position at which the second movement regulated portion 346 is brought into contact with the second movement regulation portion 164. The sub-housing 300 cannot be pivotally moved beyond the second limit position.

As described above, in the present embodiment, each of the first movement regulation portion 162 and the second movement regulation portion 164 regulates a movement of the sub-housing 300 in the first direction in parallel to the XZ-plane. In addition, the second movement regulation portion 164 regulates another movement of the sub-housing 300 in the second direction which is in parallel to the XZ-plane but different from the first direction. In the present embodiment, the first direction is one of the opposite pivoting directions of the sub-housing 300 about the sub-shafts 350 (see FIG. 14), and the second direction is a remaining one of the opposite pivoting directions of the sub-housing 300 about the sub-shafts 350.

In the present embodiment, the first movement regulation portion 162 and the second movement regulation portion 164 of the movement regulation portion 160 define a movable range of the pivoting movement of the sub-housing 300. Referring to FIG. 14, the movement regulation portion 160 includes the sub-bearings 150. The sub-bearings 150 define another movable range of a sliding movement of the sub-housing 300 in the radial direction. The sub-housing 300 is movable within the movable range defined by the movement regulation portion 160 in the XZ-plane but cannot be moved beyond the movable range.

Referring to FIGS. 13 and 14, the movement regulation portion 160 according to the present embodiment consists of the first movement regulation portion 162, the second movement regulation portion 164 and the sub-bearings 150. However, the present invention is not limited thereto, but the movement regulation portion 160 may be formed variously. For example, the second movement regulation portion 164 may regulate a sliding movement of the sub-housing 300 in an orientation away from the axis portions 120 in the radial direction. Moreover, the housing 110 may have, in addition to the sub-bearings 150, a movement regulation portion which regulates another sliding movement of the sub-housing 300 in another orientation approaching the axis portions 120 in the radial direction.

Referring to FIG. 13, the guide portion 450 of the mating housing 410 includes the sloping surfaces 462, the first regulation portions (first wall surfaces) 472 and the second regulation portion (facing wall surface) 480. The front plate 320 works as the guided portion 320 which is guided by the guide portion 450. The aforementioned movement regulation portion 160 restricts the movable range of the sub-housing 300 relative to the housing 110 within a range within which the guide portion 450 can guide the guided portion 320.

Figure 20A:
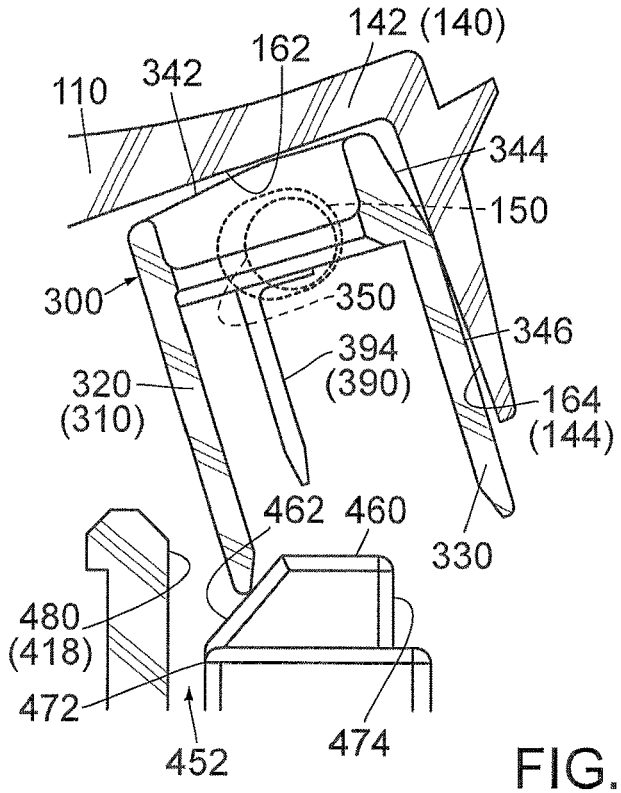
FIG. 20A and FIG. 20B are views each of which shows a positional relation among the guide portion, the guided portion, a movement regulation portion and a movement regulated portion of the connector device of FIG. 13, wherein the guided portion is brought into abutment with the guide portion, and positions of a sub-shaft and a sub-bearing are illustrated in dashed line.

Referring to FIG. 20A, in a case where the sub-housing 300 is located in the vicinity of the second limit position, an end of the front plate 320 of the sub-housing 300, or a lower end of the front plate 320 illustrated in FIG. 13, is brought into contact with the sloping surfaces 462 while the state of the connector 100 is changed to the connected state. The sloping surfaces 462 slopes downward toward the guide channel 452. Therefore, when the clockwise turn of the housing 110 is continued, the front plate 320 is guided to the guide channel 452. In contrast, referring to FIG. 20B, in another case where the sub-housing 300 is located in the vicinity of the first limit position, the front plate 320 of the sub-housing 300 is brought into contact with the facing wall surface 480 to be guided to the guide channel 452 while the state of the connector 100 is changed to the connected state.

Figure 20B:
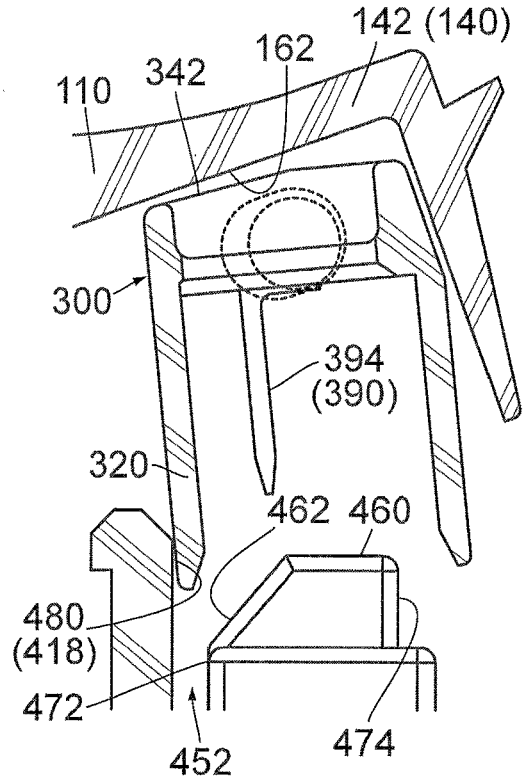
Figure 21:
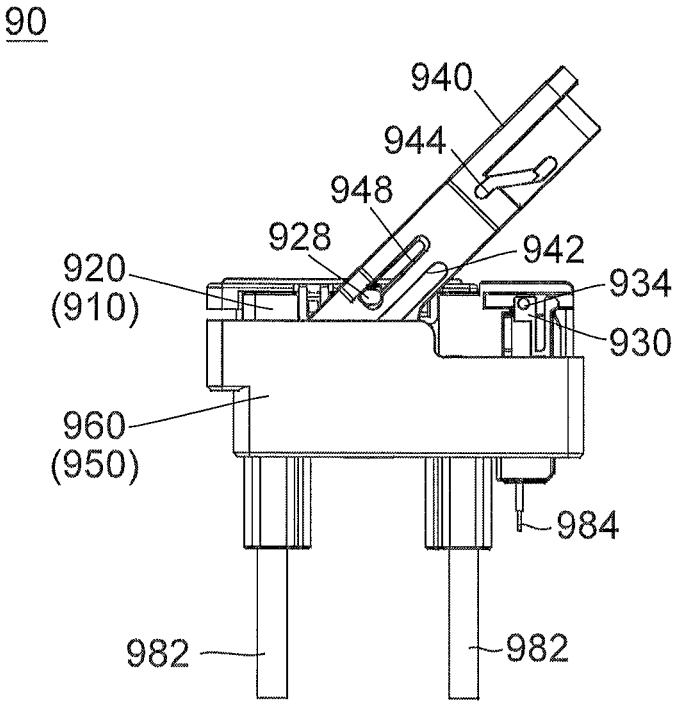
FIG.21 PRIOR ART
FIG. 21 is a side view showing a connector device of Patent Document 1.

Referring to FIGS. 13, 20A and 20B, in the present embodiment, while the state of the connector 100 is changed to the connected state, the front plate 320 is brought into contact with the sloping surfaces 462 or the facing wall surface 480 to be guided. In particular, the front plate 320 of the present embodiment is brought into contact with the sloping surfaces 462 or the facing wall surface 480 while the state of the connector 100 is changed from the unconnected state to the intermediate state. However, the present invention is not limited thereto. For example, the front plate 320 may be brought into contact with the sloping surfaces 462 or the facing wall surface 480 while the state of the connector 100 is changed from the intermediate state to the connected state. Moreover, the front plate 320 may be brought into contact with a sloping upper surface of the holding portion 418 to be guided to the guide channel 452. Moreover, a part other than the front plate 320 may work as the guided portion. For example, the rear plate 330 may be designed to work as the guided portion.

Referring to FIGS. 13 and 17, when the clockwise turn of the housing 110 is continued, the front plate 320 which is guided to the guide channel 452 is moved downward inside the guide channel 452. Thus, while the state of the connector 100 is changed from the intermediate state to the connected state, the front plate 320 is guided between the first wall surfaces 472 of the partition walls 460 and the facing wall surface 480 of the holding portion 418. In the present embodiment, each of the first wall surfaces 472 works as the first regulation portion 472 and regulates a rearward movement of the sub-housing 300 while the state of the connector 100 is changed from the intermediate state to the connected state. On the other hand, the facing wall surface 480 works as the second regulation portion 480 and regulates a forward movement of the sub-housing 300 while the state of the connector 100 is changed from the intermediate state to the connected state.

In the present embodiment, each of the first regulation portions 472 and the second regulation portion 480 regulates the movement of the guided portion 320 in the X-direction mainly while the state of the connector 100 is changed from the intermediate state to the connected state. However, the present invention is not limited thereto. For example, each of the first regulation portions 472 and the second regulation portion 480 may regulate the movement of the guided portion 320 in the X-direction also while the state of the connector 100 is changed from the unconnected state to the intermediate state. Moreover, each of the first regulation portion and the second regulation portion may be a part other than the first wall surfaces 472 and the facing wall surface 480, provided that each of the first regulation portion and the second regulation portion is located rearward of the mating axis portions 420.

Referring to FIG. 13, for example, the second wall surface 474 of each of the partition walls 460 may work as the second regulation portion 474. In other words, the guide portion 450 may include the second regulation portions 474 instead of the second regulation portion 480 or in addition to the second regulation portion 480. In this case, each of the second wall surfaces 474 may regulate a forward movement of the rear plate 330 of the sub-housing 300 while the state of the connector 100 is changed to the connected state. In the case where the second wall surfaces 474 regulate the movement of the rear plate 330, an upper part of each of the second wall surfaces 474, which is located above the mating sub-housing 600 in the Z-direction, is preferred to be a sloping surface which extends to a rear surface of the mating sub-housing 600 in the X-direction. In other words, a lower end of the upper part of each of the second wall surfaces 474 is preferred to be located at a position in the X-direction same as a position of an upper end of the rear surface of the mating sub-housing 600 in the X-direction.

The guide portion 450, which includes the second wall surfaces 474 and the facing wall surface 480, guides the guided portion 320 as described above while the state of the connector 100 is changed from the intermediate state to the connected state, so that ends of the detection terminal 390, or lower ends of the contact portions 394 in FIG. 13, face the openings 632 in the Z-direction, respectively, and are then moved to the cover 630 of the sub-housing 300. In detail, each of the ends of the detection terminal 390 faces a corresponding one of the openings 632 in the Z-direction when the each end of the detection terminal 390 is moved to be located at a position same as that of an upper end of the corresponding opening 632 in the Z-direction. At that time, the each end of the detection terminal 390 is located at a position almost same as that of a corresponding one of the mating detection terminals 700 in each of the X-direction and the Y-direction. In the present embodiment, the ends of the detection terminal 390 almost face the openings 632, respectively, at a timing when the state of the connector 100 is just changed to the intermediate state. However, the present invention is not limited thereto. The ends of the detection terminal 390 may face the openings 632, respectively, only while the state of the connector 100 is changed from the intermediate state to the connected state.

The rectangular cylindrical portion 310 of the sub-housing 300 opens toward the mating detection terminals 700 in a clockwise direction along which the housing 110 is turned so that the state of the connector 100 is changed to the connected state. Referring to FIGS. 13 and 17, when the clockwise turn of the housing 110 shown in FIG. 13 is continued, the rectangular cylindrical portion 310 is linearly moved downward along the Z-direction while enclosing the mating sub-housing 600 and the partition walls 460 in the XY-plane. In other words, the mating sub-housing 600 and the partition walls 460 as a whole guide the rectangular cylindrical portion 310 and convert a turning movement of the housing 110 into a linear movement of the sub-housing 300.

As can be seen from FIGS. 13, 17 and 18, when the guided portion 320 is continuously guided by the guide portion 450, the rectangular cylindrical portion 310 of the sub-housing 300 encloses the mating sub-housing 600 and the partition walls 460 in the XY-plane. Thereafter, the sub-housing 300 is moved downward along the Z-direction relative to the mating sub-housing 600, while the sub-housing 300 is hardly moved in any of the X-direction and the Y-direction relative to the mating sub-housing 600. However, the sub-housing 300 is slightly moved relative to the housing 110 in the X-direction.

Referring to FIG. 19, when the rectangular cylindrical portion 310 encloses the mating sub-housing 600 and the partition walls 460, the ends of the detection terminal 390 face the openings 632, respectively. Therefore, even if each of the ends of the detection terminal 390 is brought into abutment with one of the sloping surfaces of the corresponding opening 632, the each end of the detection terminal 390 is guided to the corresponding holding hole 610 by the sloping surface. Thus, with no buckling due to abutment with the mating sub-housing 600, the contact portions 394 of the detection terminal 390 are linearly moved downward, or toward the mating contact portions 710 of the mating detection terminals 700, respectively, to be brought into contact with the mating contact portions 710, respectively.

Referring to FIG. 13, as described above, while the state of the connector 100 is changed from the intermediate state to the connected state, the guide portion 450 guides the guided portion 320 to move the sub-housing 300 relative to the housing 110. As a result, the detection terminal 390 is moved downward along the Z-direction to be connected to the mating detection terminals 700. According to the present invention, the sub-housing 300 is movable relative to the mating housing 410 with no cam mechanism.

The aforementioned present embodiment can be further variously modified in addition to the already explained modifications.

For example, referring to FIG. 19, in the present embodiment, the detection terminal 390 is a pin terminal with the two contact portions 394 each having a pin-shape, and each of the mating detection terminals 700 is a socket terminal.

However, the present invention is not limited thereto, but the detection terminal 390 may be a socket terminal, and each of the mating detection terminals 700 may be a pin terminal.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector device comprising a connector and a mating connector mateable with each other, wherein:

the connector comprises a housing, a power terminal, a sub-housing and a detection terminal;

the power terminal is held by the housing;

the detection terminal is held by the sub-housing;

the sub-housing is supported by the housing and is movable relative to the housing;

the mating connector comprises a mating housing, a mating power terminal and a mating detection terminal;

the mating power terminal and the mating detection terminal are held by the mating housing;

the housing is formed with an axis portion;

the mating housing is formed with a mating axis portion;

one of the axis portion and the mating axis portion is a shaft, and a remaining one of the axis portion and the mating axis portion is a bearing;

the shaft extends in an axial direction;

under a state where the shaft and the bearing are combined with each other, the housing is turnable about the shaft relative to the mating housing;

a turn of the housing relative to the mating housing changes a state of the connector between an unconnected state and a connected state via an intermediate state;

when the connector takes the unconnected state, the power terminal is unconnected to the mating power terminal, and the detection terminal is unconnected to the mating detection terminal;

when the connector takes the intermediate state, the power terminal is connected to the mating power terminal, but the detection terminal is unconnected to the mating detection terminal;

when the connector takes the connected state, the power terminal is connected to the mating power terminal, and the detection terminal is connected to the mating detection terminal;

the sub-housing has a guided portion;

the mating housing has a guide portion; and while the state of the connector is changed from the intermediate state to the connected state, the guide portion guides the guided portion to move the sub-housing relative to the housing, so that the detection terminal is moved downward along an upper-lower direction perpendicular to the axial direction to be connected to the mating detection terminal.

2. The connector device as recited in claim 1, wherein:

the detection terminal is a pin terminal; and the mating detection terminal is a socket terminal.

3. The connector device as recited in claim 2, wherein:

the mating housing is provided with a cover which covers the mating detection terminal in the upper-lower direction;

the cover is formed with openings;

the detection terminal has contact portions;

when the connector takes the connected state, the contact portions of the detection terminal pass through the openings along the upper-lower direction, respectively, and are connected to mating contact portions of the mating detection terminal, respectively; and the guide portion guides the guided portion while the state of the connector is changed from the intermediate state to the connected state, so that ends of the contact portions face the openings in the upper-lower direction, respectively, and are then moved to the cover.

4. The connector device as recited in claim 1, wherein:

the sub-housing is swingingly movable along a perpendicular plane perpendicular to the axial direction;

the housing has a first movement regulation portion and a second movement regulation portion;

the first movement regulation portion regulates a movement of the sub-housing in a first direction in parallel to the perpendicular plane; and the second movement regulation portion regulates another movement of the sub-housing in a second direction which is in parallel to the perpendicular plane but different from the first direction.

5. The connector device as recited in claim 4, wherein:

the sub-housing is formed with a sub-shaft;

the sub-shaft extends in parallel to the axial direction;

the housing is formed with a sub-bearing; and the sub-bearing receives the sub-shaft.

6. The connector device as recited in claim 5, wherein the sub-bearing is a long hole which extends long in a radial direction about the shaft.

7. The connector device as recited in claim 5, wherein:

the sub-housing is pivotally movable about the sub-shaft relative to the housing in each of opposite pivoting directions;

the first direction is one of the pivoting directions of the sub-housing; and the second direction is a remaining one of the pivoting directions of the sub-housing.

8. The connector device as recited in claim 1, wherein:

the guide portion of the mating housing includes a sloping surface which is oblique to the upper-lower direction; and while the state of the connector is changed to the connected state, the guided portion is brought into contact with the sloping surface.

9. The connector device as recited in claim 1, wherein:

the guide portion of the mating housing includes a first regulation portion and a second regulation portion;

each of the first regulation portion and the second regulation portion is located rearward of the mating axis portion in a front-rear direction perpendicular to both the axial direction and the upper-lower direction; and while the state of the connector is changed from the intermediate state to the connected state, the first regulation portion regulates a rearward movement of the sub-housing, and the second regulation portion regulates a forward movement of the sub-housing.

10. The connector device as recited in claim 9, wherein:

the mating housing has a first wall surface which works as the first regulation portion; and the first wall surface is located forward of the mating detection terminal.

11. The connector device as recited in claim 10, wherein:

the sub-housing has a front plate which works as the guided portion;

the front plate is nearer to the axis portion than the detection terminal; and while the state of the connector is changed to the connected state, an end of the front plate is brought into contact with the guide portion.

12. The connector device as recited in claim 11, wherein:

the mating housing has a facing wall surface which works as the second regulation portion;

the facing wall surface faces the first wall surface in the front-rear direction; and while the state of the connector is changed from the intermediate state to the connected state, the front plate of the sub-housing is guided between the first wall surface and the facing wall surface.

13. The connector device as recited in claim 11, wherein:

the mating housing has a second wall surface which works as the second regulation portion;

the second wall surface is located rearward of the mating detection terminal;

the sub-housing has a rear plate;

the rear plate is farther from the axis portion than the detection terminal; and while the state of the connector is changed to the connected state, the second wall surface regulates a forward movement of the rear plate.

14. The connector device as recited in claim 13, wherein:

the sub-housing has a rectangular cylindrical portion; and the rectangular cylindrical portion opens toward the mating detection terminal in a direction along which the housing is turned so that the state of the connector is changed to the connected state; and each of the front plate and the rear plate is a part of the rectangular cylindrical portion.

* * * * *